US007775619B2

(12) United States Patent
Kawabata

(10) Patent No.: US 7,775,619 B2
(45) Date of Patent: Aug. 17, 2010

(54) IMAGE FORMING APPARATUS

(75) Inventor: Kenichi Kawabata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 813 days.

(21) Appl. No.: 11/522,002

(22) Filed: Sep. 14, 2006

(65) Prior Publication Data

US 2007/0064032 A1 Mar. 22, 2007

(30) Foreign Application Priority Data

Sep. 16, 2005 (JP) ..... 2005-269437

(51) Int. Cl.
*B41J 29/38* (2006.01)
*B41J 2/01* (2006.01)
*B41J 3/407* (2006.01)

(52) U.S. Cl. ..... 347/16; 347/104; 347/106

(58) Field of Classification Search ..... 347/16, 347/104; 399/364, 401, 406
See application file for complete search history.

(56) References Cited

U.S. PATENT DOCUMENTS

2004/0263553 A1* 12/2004 Mizuno ..... 347/16
2005/0194730 A1* 9/2005 Nishida et al. ..... 271/10.01
2005/0275672 A1* 12/2005 Koshikawa ..... 347/5

FOREIGN PATENT DOCUMENTS

| | | |
|---|---|---|
| JP | 2000-1010 | 1/2000 |
| JP | 2000-246981 | 9/2000 |
| JP | 2004-175490 | 6/2004 |

* cited by examiner

*Primary Examiner*—Matthew Luu
*Assistant Examiner*—Kendrick X Liu
(74) *Attorney, Agent, or Firm*—Cooper & Dunham LLP

(57) ABSTRACT

An image forming apparatus includes a transport belt rotating around rollers that transports a sheet by attaching the sheet thereto by an electrostatic force, an image forming unit which forms an image on the sheet transported by the transport belt by ejecting ink droplets from a recording head onto the sheet, and an duplex print unit which reverses the sheet, the first side of which has been printed, so as to form an image on the second side of the sheet. The apparatus stops the transportation of the sheet to the image forming unit after the image is formed on the first side of the sheet and before the image is formed on the second side of the sheet until at least the tip of the second side of the sheet is not apart from the transport belt.

22 Claims, 22 Drawing Sheets

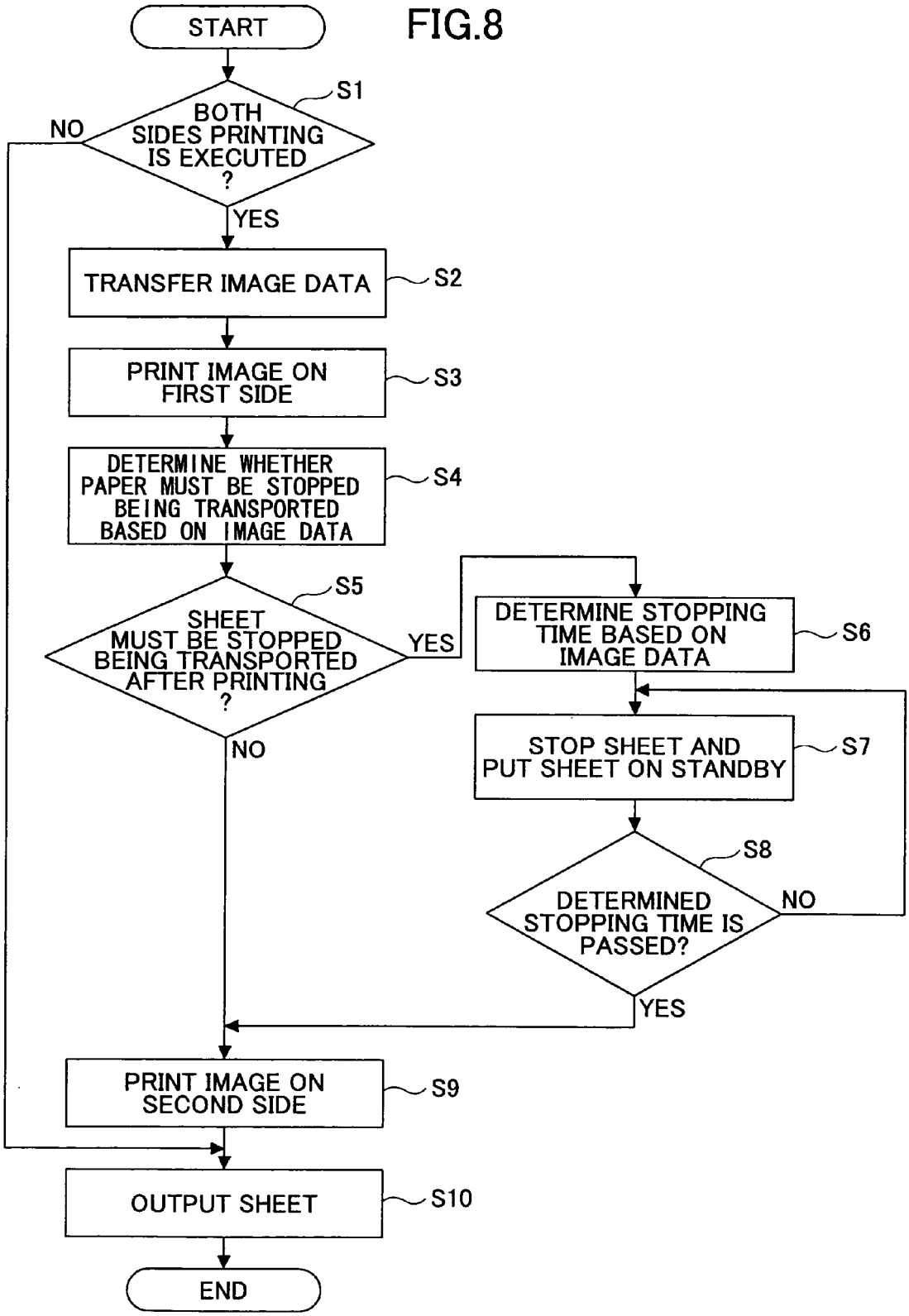
FIG.8
START
S1
BOTH SIDES PRINTING IS EXECUTED ?
NO
YES
TRANSFER IMAGE DATA
S2
PRINT IMAGE ON FIRST SIDE
S3
DETERMINE WHETHER PAPER MUST BE STOPPED BEING TRANSPORTED BASED ON IMAGE DATA
S4
S5
SHEET MUST BE STOPPED BEING TRANSPORTED AFTER PRINTING ?
YES
NO
DETERMINE STOPPING TIME BASED ON IMAGE DATA
S6
STOP SHEET AND PUT SHEET ON STANDBY
S7
S8
DETERMINED STOPPING TIME IS PASSED?
NO
YES
PRINT IMAGE ON SECOND SIDE
S9
OUTPUT SHEET
S10
END

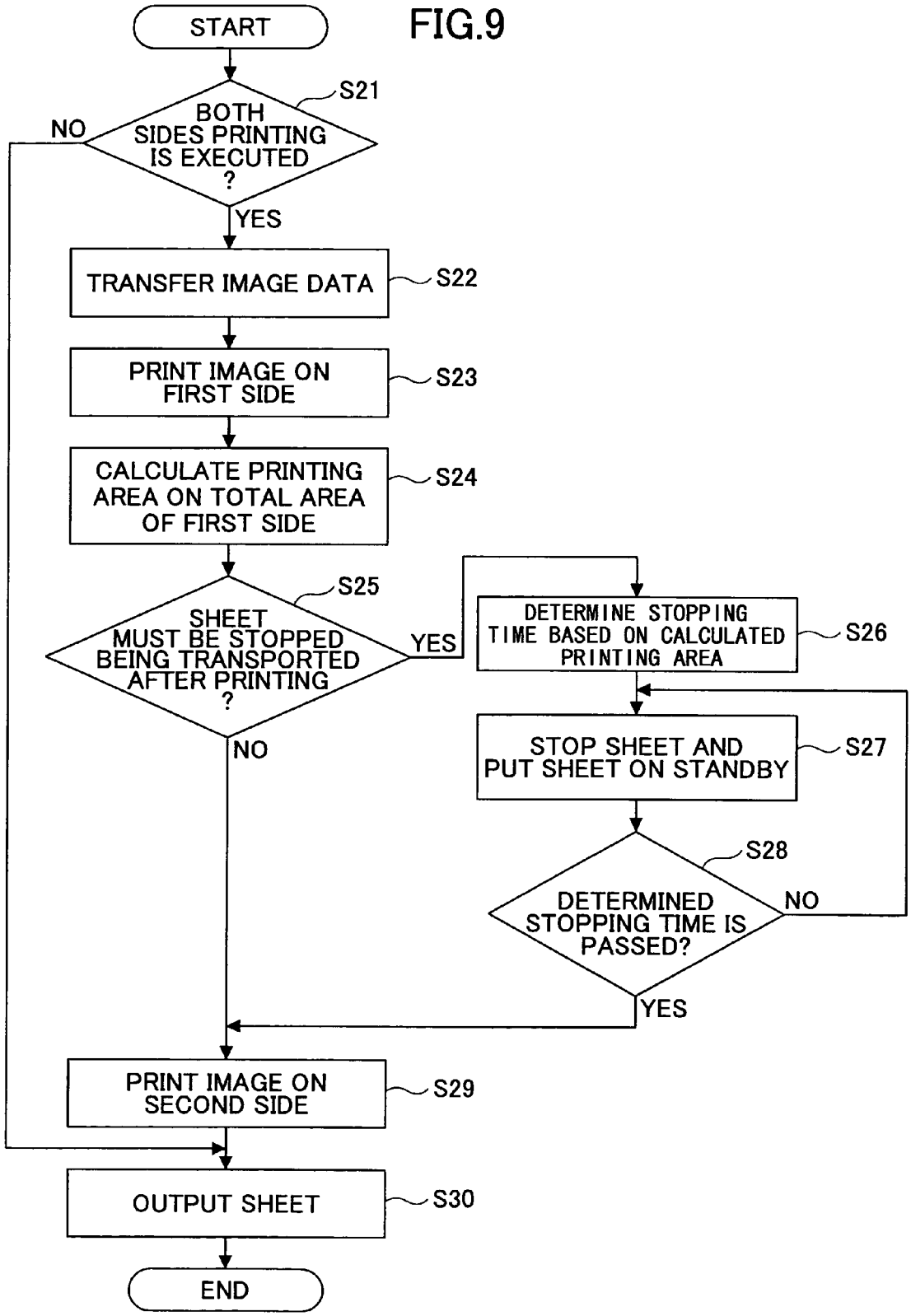
FIG.9
START
S21
BOTH SIDES PRINTING IS EXECUTED ?
NO
YES
TRANSFER IMAGE DATA
S22
PRINT IMAGE ON FIRST SIDE
S23
CALCULATE PRINTING AREA ON TOTAL AREA OF FIRST SIDE
S24
S25
SHEET MUST BE STOPPED BEING TRANSPORTED AFTER PRINTING ?
YES
NO
DETERMINE STOPPING TIME BASED ON CALCULATED PRINTING AREA
S26
STOP SHEET AND PUT SHEET ON STANDBY
S27
S28
DETERMINED STOPPING TIME IS PASSED?
NO
YES
PRINT IMAGE ON SECOND SIDE
S29
OUTPUT SHEET
S30
END

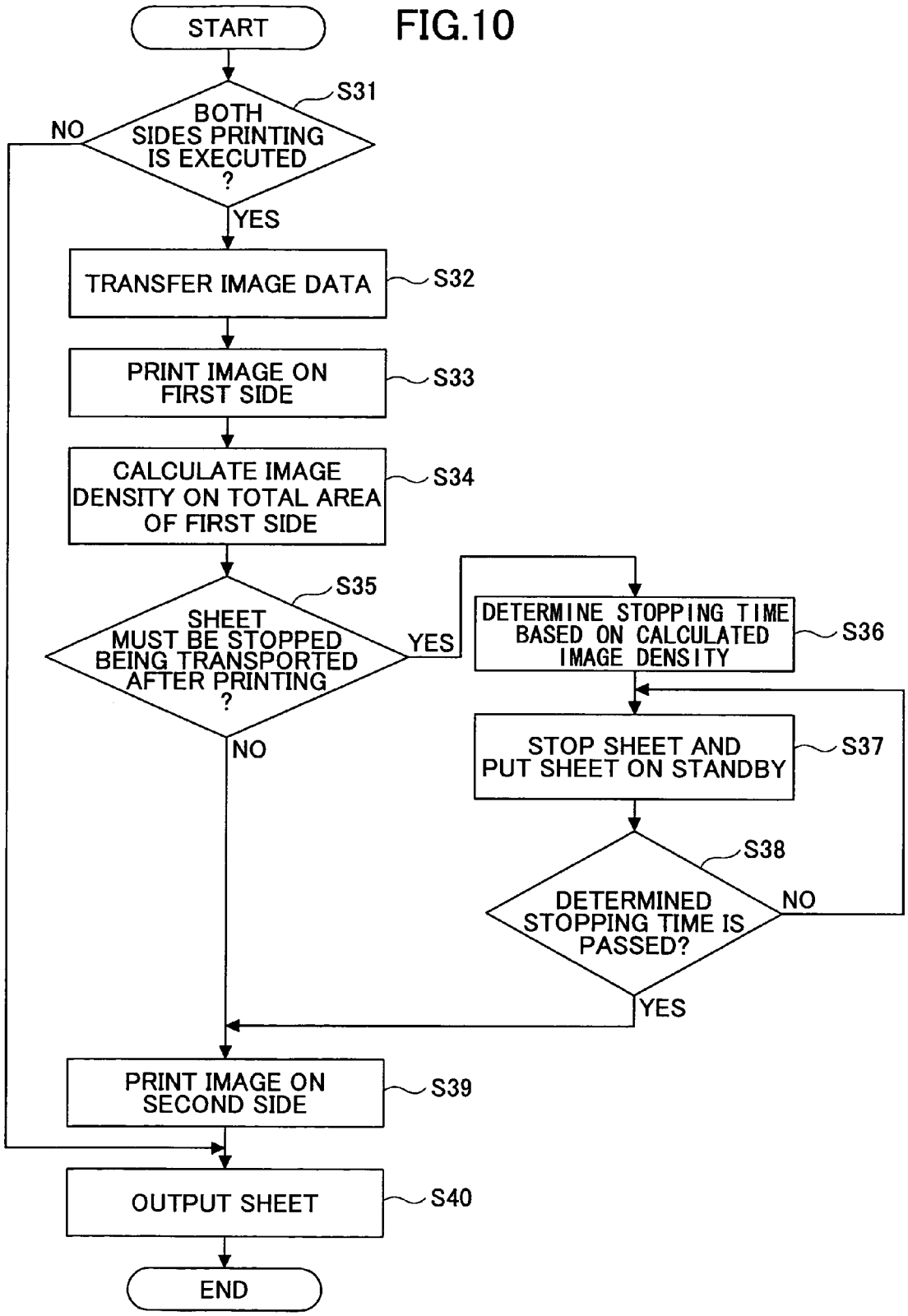
FIG.10
START
S31
BOTH SIDES PRINTING IS EXECUTED ?
NO
YES
TRANSFER IMAGE DATA
S32
PRINT IMAGE ON FIRST SIDE
S33
CALCULATE IMAGE DENSITY ON TOTAL AREA OF FIRST SIDE
S34
S35
SHEET MUST BE STOPPED BEING TRANSPORTED AFTER PRINTING ?
YES
NO
DETERMINE STOPPING TIME BASED ON CALCULATED IMAGE DENSITY
S36
STOP SHEET AND PUT SHEET ON STANDBY
S37
S38
DETERMINED STOPPING TIME IS PASSED?
NO
YES
PRINT IMAGE ON SECOND SIDE
S39
OUTPUT SHEET
S40
END

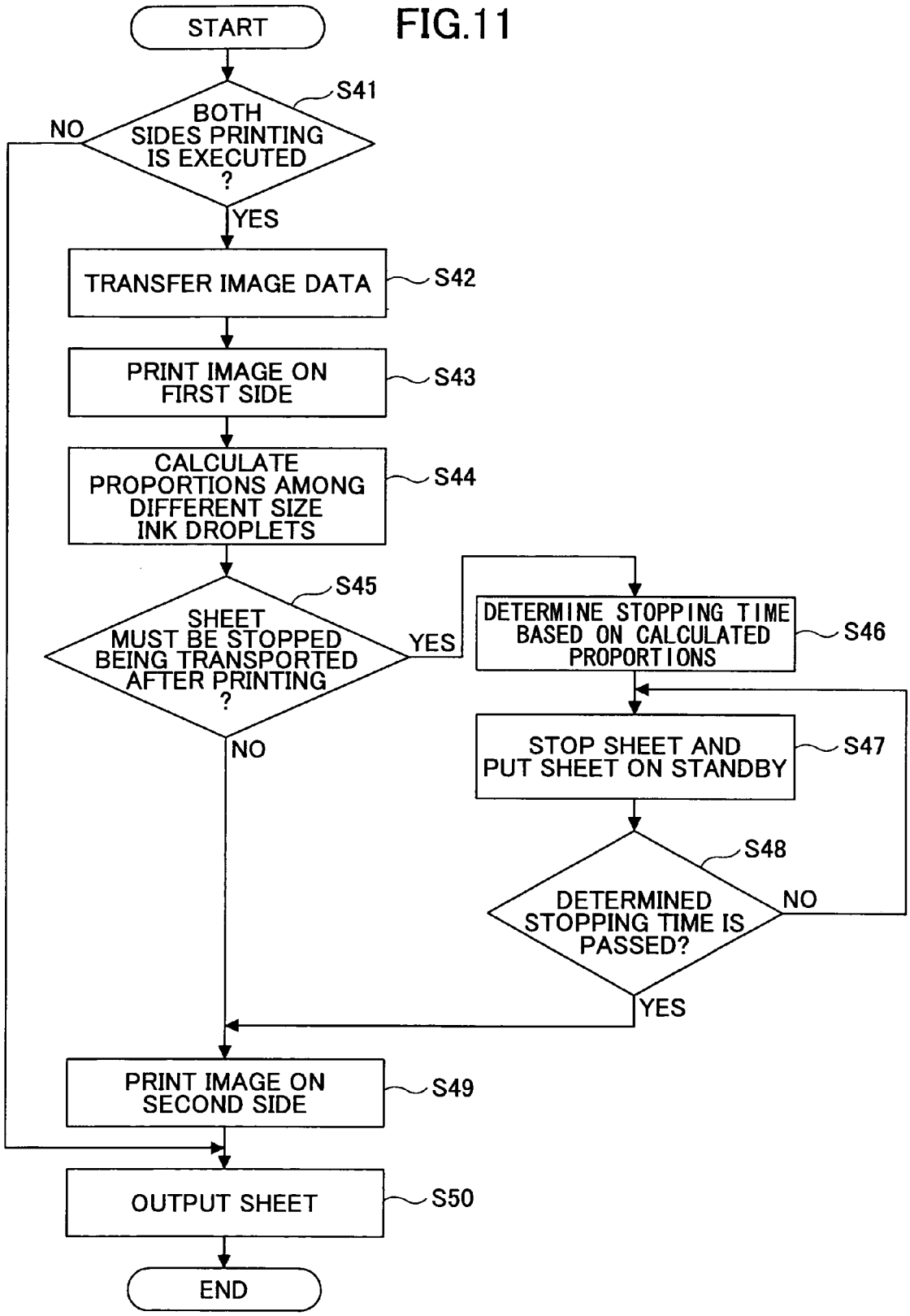
FIG.11
START
BOTH SIDES PRINTING IS EXECUTED ?
S41
NO
YES
TRANSFER IMAGE DATA
S42
PRINT IMAGE ON FIRST SIDE
S43
CALCULATE PROPORTIONS AMONG DIFFERENT SIZE INK DROPLETS
S44
SHEET MUST BE STOPPED BEING TRANSPORTED AFTER PRINTING ?
S45
YES
NO
DETERMINE STOPPING TIME BASED ON CALCULATED PROPORTIONS
S46
STOP SHEET AND PUT SHEET ON STANDBY
S47
DETERMINED STOPPING TIME IS PASSED?
S48
NO
YES
PRINT IMAGE ON SECOND SIDE
S49
OUTPUT SHEET
S50
END

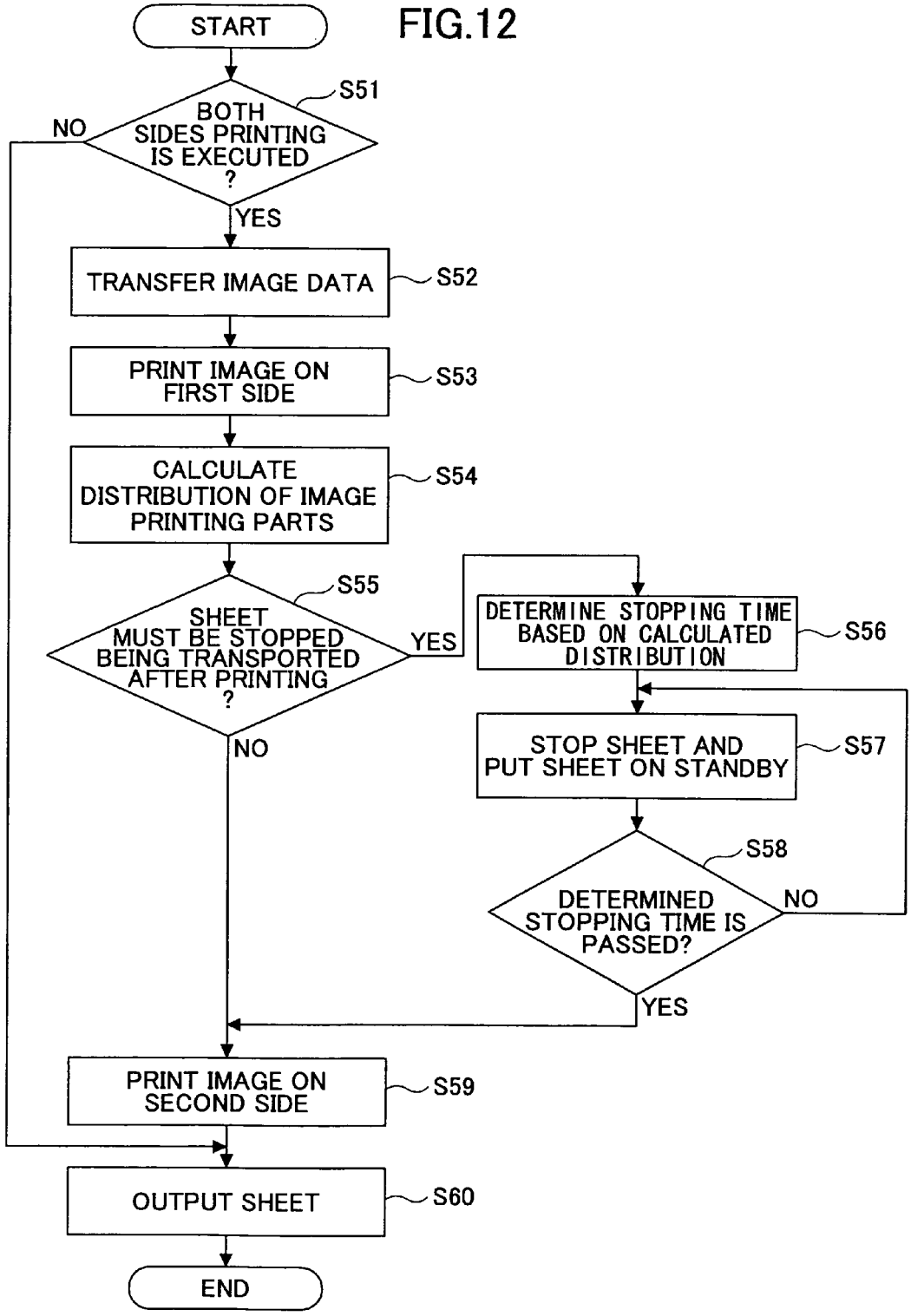
FIG.12
START
BOTH SIDES PRINTING IS EXECUTED ?
S51
NO
YES
TRANSFER IMAGE DATA
S52
PRINT IMAGE ON FIRST SIDE
S53
CALCULATE DISTRIBUTION OF IMAGE PRINTING PARTS
S54
SHEET MUST BE STOPPED BEING TRANSPORTED AFTER PRINTING ?
S55
YES
NO
DETERMINE STOPPING TIME BASED ON CALCULATED DISTRIBUTION
S56
STOP SHEET AND PUT SHEET ON STANDBY
S57
DETERMINED STOPPING TIME IS PASSED?
S58
NO
YES
PRINT IMAGE ON SECOND SIDE
S59
OUTPUT SHEET
S60
END

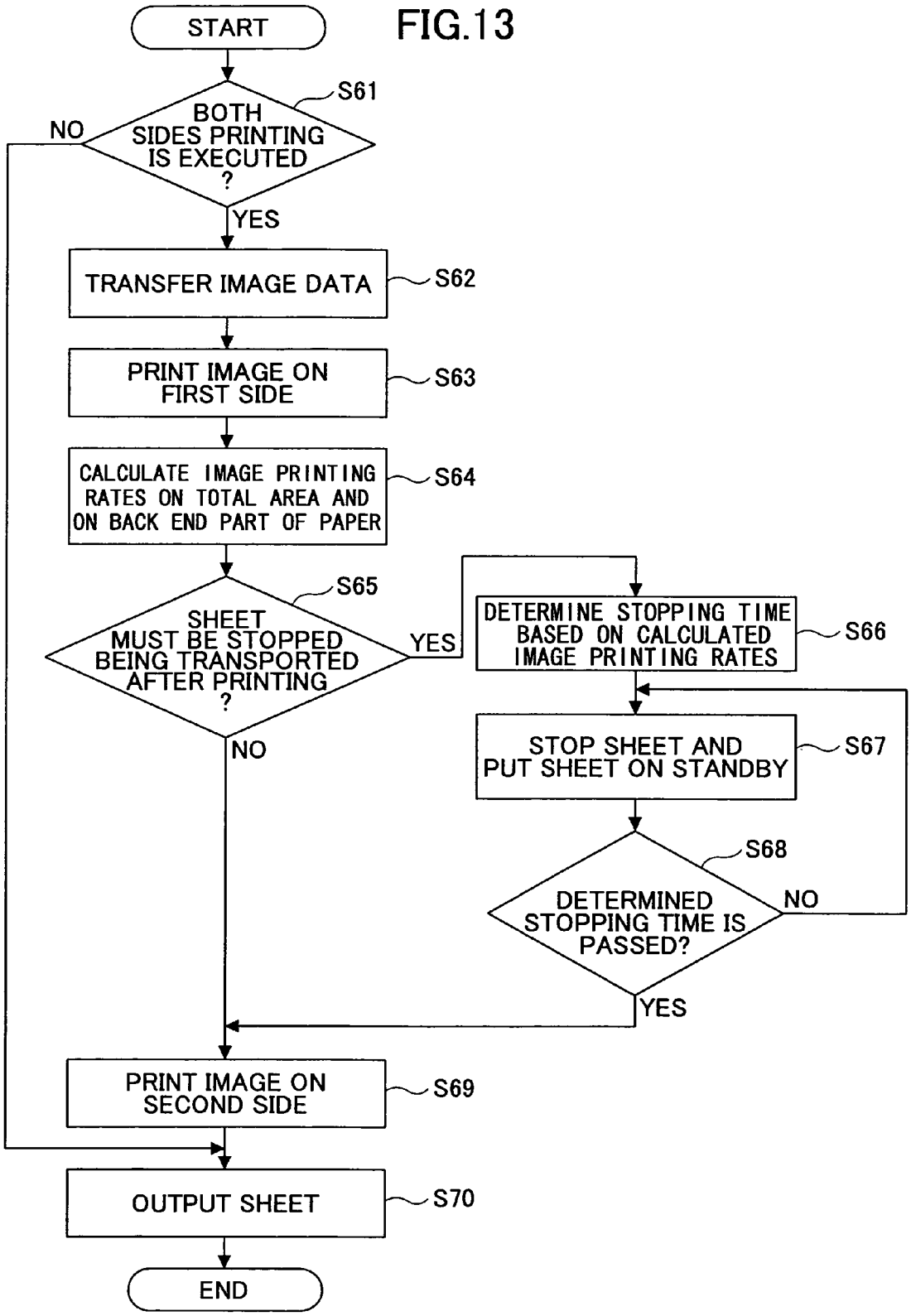
FIG.13
START
S61
BOTH SIDES PRINTING IS EXECUTED ?
NO
YES
TRANSFER IMAGE DATA
S62
PRINT IMAGE ON FIRST SIDE
S63
CALCULATE IMAGE PRINTING RATES ON TOTAL AREA AND ON BACK END PART OF PAPER
S64
S65
SHEET MUST BE STOPPED BEING TRANSPORTED AFTER PRINTING ?
YES
NO
DETERMINE STOPPING TIME BASED ON CALCULATED IMAGE PRINTING RATES
S66
STOP SHEET AND PUT SHEET ON STANDBY
S67
S68
DETERMINED STOPPING TIME IS PASSED?
NO
YES
PRINT IMAGE ON SECOND SIDE
S69
OUTPUT SHEET
S70
END

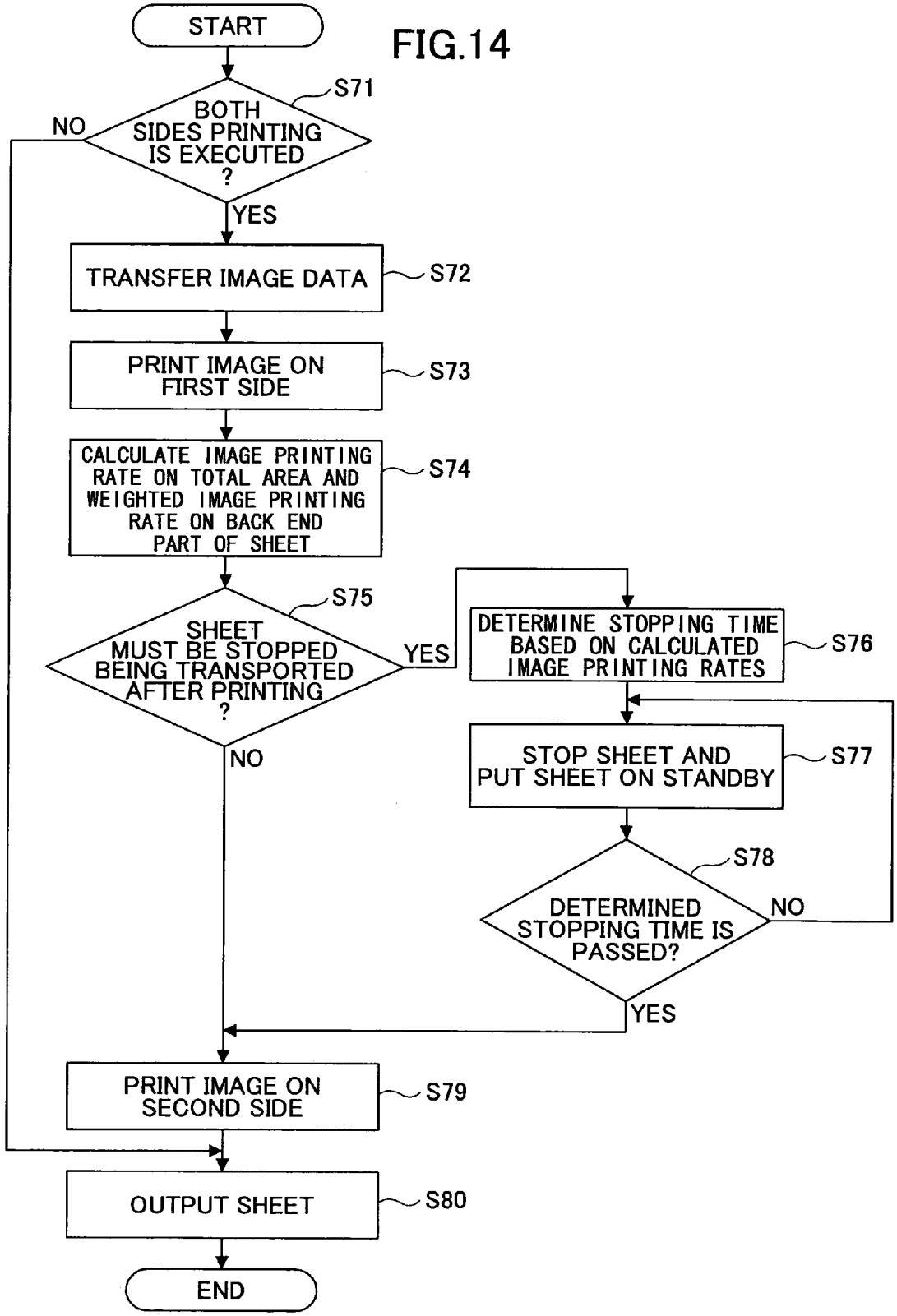
FIG.14
START
S71
BOTH SIDES PRINTING IS EXECUTED ?
NO
YES
TRANSFER IMAGE DATA
S72
PRINT IMAGE ON FIRST SIDE
S73
CALCULATE IMAGE PRINTING RATE ON TOTAL AREA AND WEIGHTED IMAGE PRINTING RATE ON BACK END PART OF SHEET
S74
S75
SHEET MUST BE STOPPED BEING TRANSPORTED AFTER PRINTING ?
YES
NO
DETERMINE STOPPING TIME BASED ON CALCULATED IMAGE PRINTING RATES
S76
STOP SHEET AND PUT SHEET ON STANDBY
S77
S78
DETERMINED STOPPING TIME IS PASSED?
NO
YES
PRINT IMAGE ON SECOND SIDE
S79
OUTPUT SHEET
S80
END

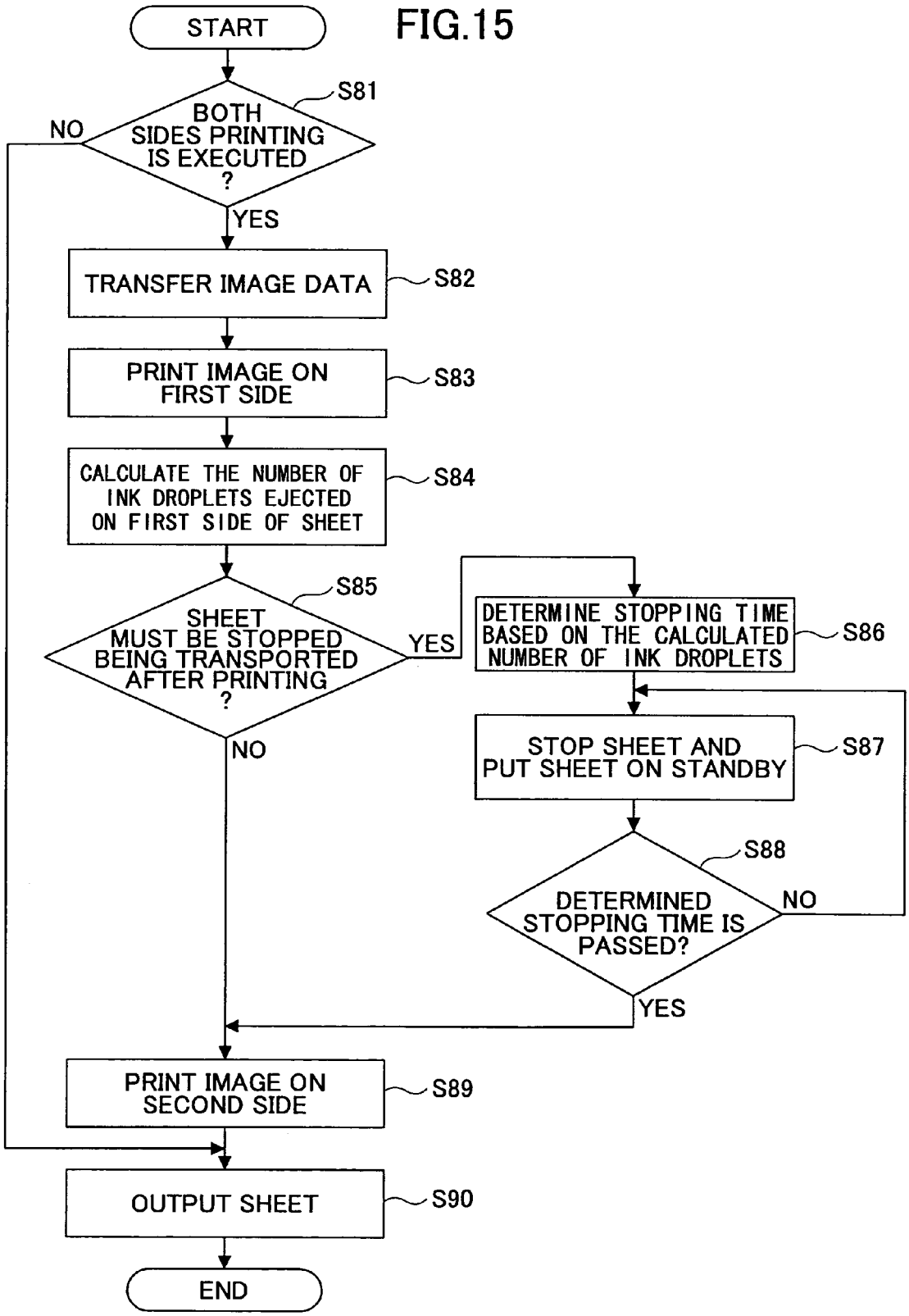
FIG.15
START
S81
BOTH SIDES PRINTING IS EXECUTED ?
NO
YES
TRANSFER IMAGE DATA
S82
PRINT IMAGE ON FIRST SIDE
S83
CALCULATE THE NUMBER OF INK DROPLETS EJECTED ON FIRST SIDE OF SHEET
S84
S85
SHEET MUST BE STOPPED BEING TRANSPORTED AFTER PRINTING ?
YES
NO
DETERMINE STOPPING TIME BASED ON THE CALCULATED NUMBER OF INK DROPLETS
S86
STOP SHEET AND PUT SHEET ON STANDBY
S87
S88
DETERMINED STOPPING TIME IS PASSED?
NO
YES
PRINT IMAGE ON SECOND SIDE
S89
OUTPUT SHEET
S90
END

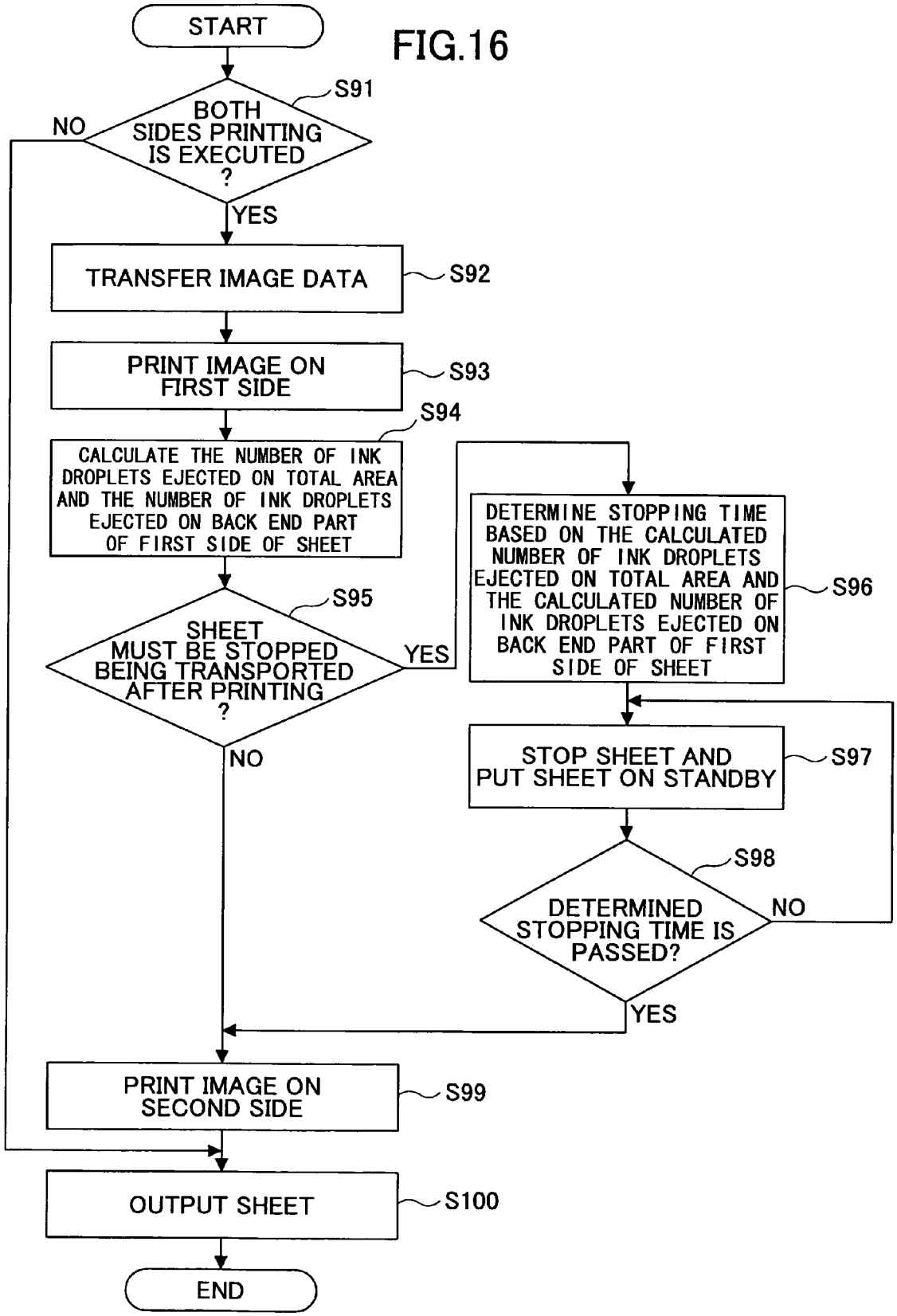
START
FIG.16
S91
BOTH SIDES PRINTING IS EXECUTED ?
NO
YES
TRANSFER IMAGE DATA
S92
PRINT IMAGE ON FIRST SIDE
S93
S94
CALCULATE THE NUMBER OF INK DROPLETS EJECTED ON TOTAL AREA AND THE NUMBER OF INK DROPLETS EJECTED ON BACK END PART OF FIRST SIDE OF SHEET
S95
SHEET MUST BE STOPPED BEING TRANSPORTED AFTER PRINTING ?
YES
NO
DETERMINE STOPPING TIME BASED ON THE CALCULATED NUMBER OF INK DROPLETS EJECTED ON TOTAL AREA AND THE CALCULATED NUMBER OF INK DROPLETS EJECTED ON BACK END PART OF FIRST SIDE OF SHEET
S96
STOP SHEET AND PUT SHEET ON STANDBY
S97
S98
DETERMINED STOPPING TIME IS PASSED?
NO
YES
PRINT IMAGE ON SECOND SIDE
S99
OUTPUT SHEET
S100
END

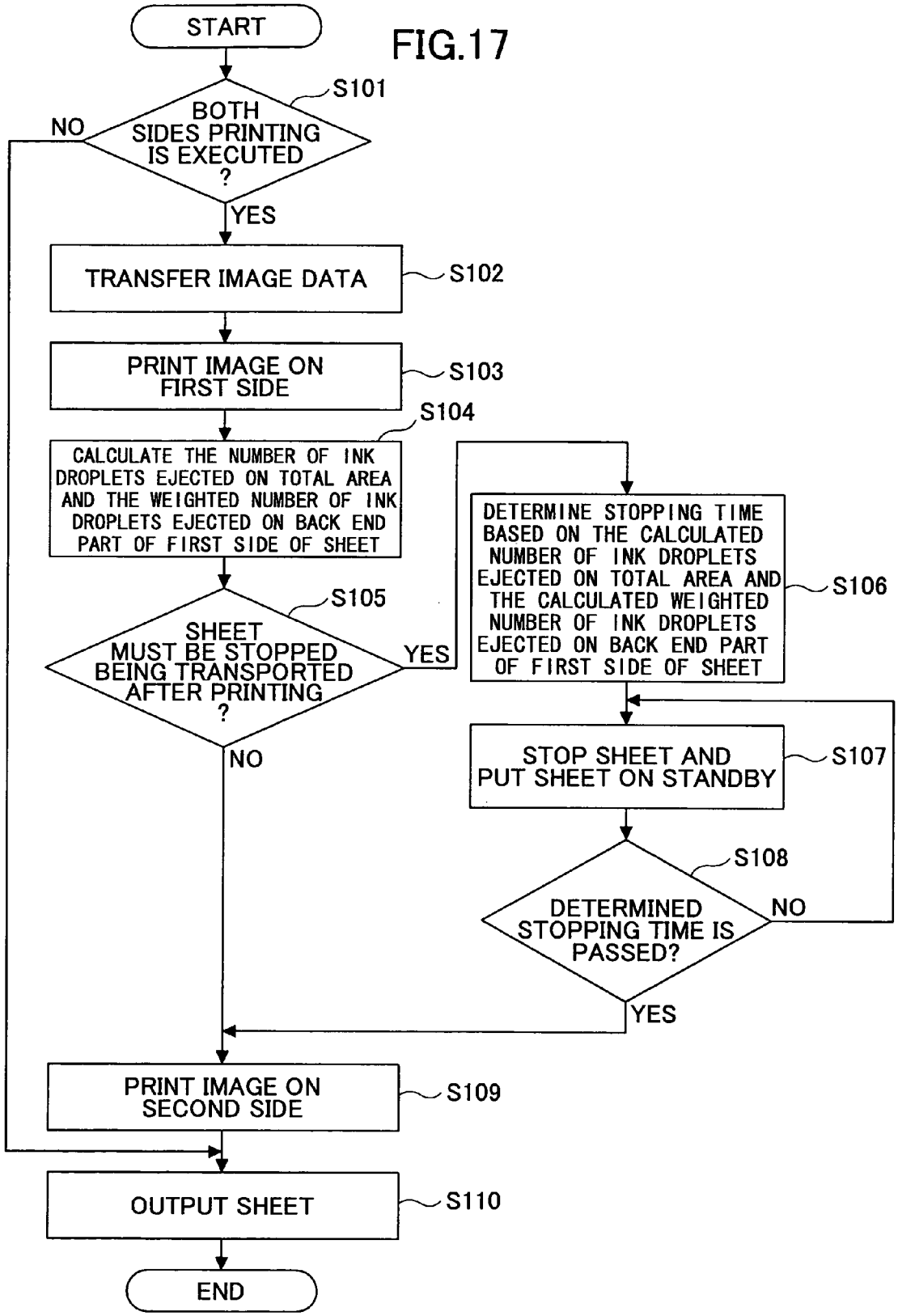
START
FIG.17
S101
BOTH SIDES PRINTING IS EXECUTED ?
NO
YES
TRANSFER IMAGE DATA
S102
PRINT IMAGE ON FIRST SIDE
S103
S104
CALCULATE THE NUMBER OF INK DROPLETS EJECTED ON TOTAL AREA AND THE WEIGHTED NUMBER OF INK DROPLETS EJECTED ON BACK END PART OF FIRST SIDE OF SHEET
S105
SHEET MUST BE STOPPED BEING TRANSPORTED AFTER PRINTING ?
YES
NO
DETERMINE STOPPING TIME BASED ON THE CALCULATED NUMBER OF INK DROPLETS EJECTED ON TOTAL AREA AND THE CALCULATED WEIGHTED NUMBER OF INK DROPLETS EJECTED ON BACK END PART OF FIRST SIDE OF SHEET
S106
STOP SHEET AND PUT SHEET ON STANDBY
S107
S108
DETERMINED STOPPING TIME IS PASSED?
NO
YES
PRINT IMAGE ON SECOND SIDE
S109
OUTPUT SHEET
S110
END

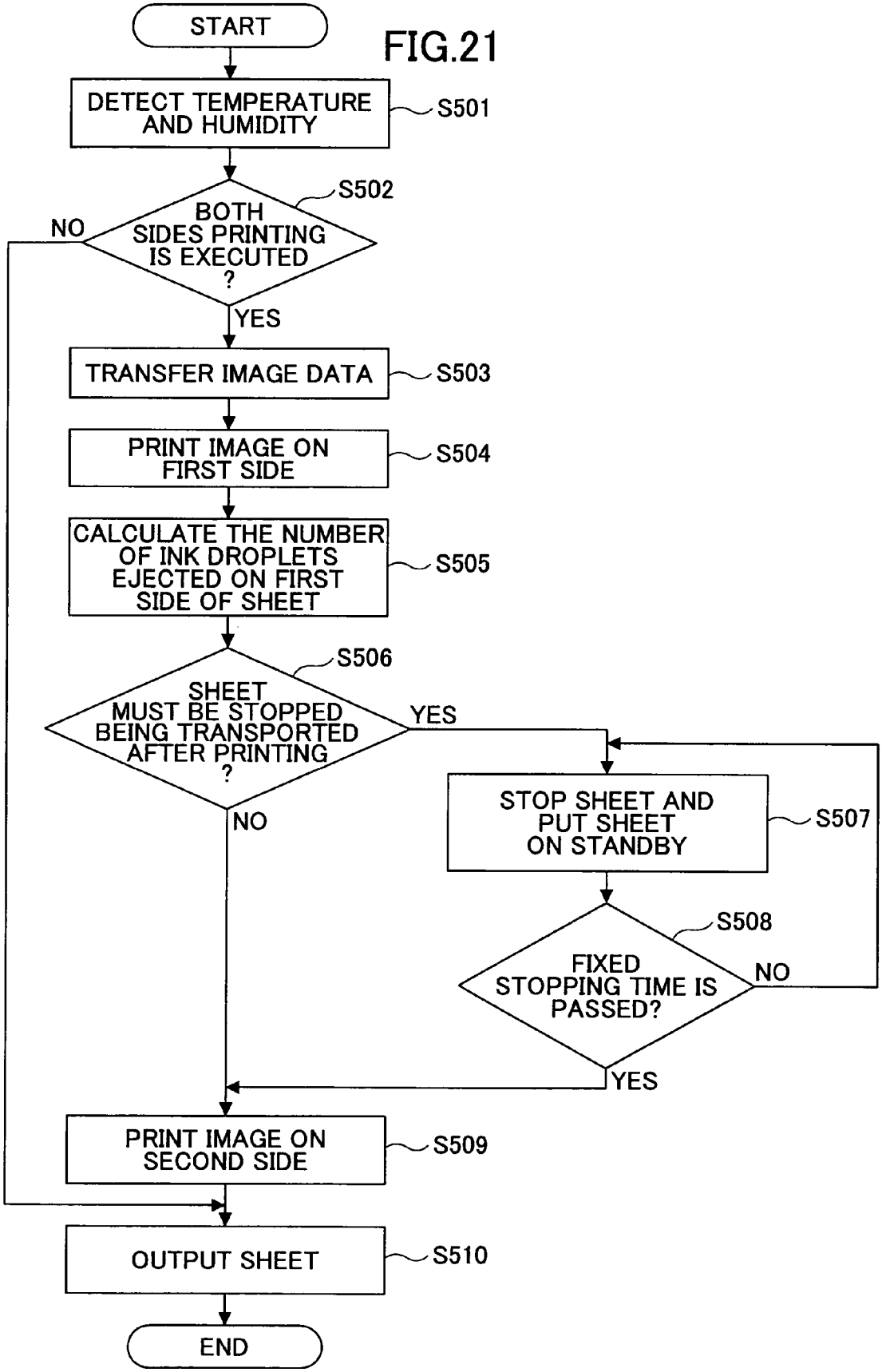
FIG.21
START
DETECT TEMPERATURE AND HUMIDITY
S501
BOTH SIDES PRINTING IS EXECUTED ?
S502
NO
YES
TRANSFER IMAGE DATA
S503
PRINT IMAGE ON FIRST SIDE
S504
CALCULATE THE NUMBER OF INK DROPLETS EJECTED ON FIRST SIDE OF SHEET
S505
SHEET MUST BE STOPPED BEING TRANSPORTED AFTER PRINTING ?
S506
YES
NO
STOP SHEET AND PUT SHEET ON STANDBY
S507
FIXED STOPPING TIME IS PASSED?
S508
NO
YES
PRINT IMAGE ON SECOND SIDE
S509
OUTPUT SHEET
S510
END

IMAGE FORMING APPARATUS

BACKGROUND

1. Technical Field

This disclosure generally relates to an image forming apparatus that can execute both sides printing on a sheet which is transported by a transport belt by an electrostatic force.

2. Description of the Related Art

As an image forming apparatus such as a printer, a facsimile, a copying apparatus, and a multifunctional apparatus that has the above functions, for example, an inkjet recording apparatus is widely known. In the inkjet recording apparatus, a recording head (an image forming unit) composed of ink droplet ejecting heads which eject ink droplets of recording liquid is used, and an image is formed on a recording medium (sheet) by ejecting the ink droplets of the recording liquid onto the recording medium from the recording head while carrying the recording medium. In this, the recording medium is not limited to a sheet, and any other recording medium such as an image transferring medium can be used as the recording medium; and as the image forming, image recording, image printing, letter printing, letter transferring and so on are included.

When an image is formed by an inkjet recording apparatus, since ink is attached onto a sheet, a phenomenon in which the sheet is stretched by water contained in the ink occurs; this phenomenon is called cockling. By the cockling, the sheet has a wave shape, and a gap between the nozzle surface of the recording head and the surface of the sheet is changed among positions. When the cockling is large, the sheet may contact the nozzle surface so that the nozzle surface is stained and the sheet is also stained. That is, image quality is degraded, and the ejection position of the ink droplet on the sheet is shifted from the original target position.

In Patent Document 1, an image recording apparatus is disclosed. In the image forming apparatus, in order to maintain the flatness of a sheet, a transport belt of an endless type is used, the sheet is attached onto the transport belt by an electrostatic force by charging a voltage on the surface of the transport belt, and the sheet is transported by the rotation of the transport belt. With this, the sheet is prevented from being separated from the transport belt and high flatness of the sheet is maintained.

[Patent Document 1] Japanese Laid-Open Patent Application No. 2004-175490

In Patent Document 2, an image transferring sheet carrying apparatus is disclosed. In the image transferring sheet carrying apparatus, since a transferred image suffers a bad effect from cockling and curling of an image transferring sheet, the image transferring sheet is attached onto an image transferring position by an electrostatic force of an electrostatic attraction member, and image transferring operations on the image transferring sheet and moving operations of the image transferring sheet are executed. Further, a switching unit is included, that is, attraction or non-attraction of the image transferring sheet by the electrostatic attraction member is switched by the switching unit based on the type of image transferring sheet being used.

[Patent Document 2] Japanese Laid-Open Patent Application No. 2000-246981

In Patent Document 3, an inkjet recording apparatus which can execute both sides printing is disclosed. In the inkjet recording apparatus, a sheet is transported by a transport belt and an image is transferred on one side of the sheet; after this, at least a part of the sheet is output from the inkjet recording apparatus. After a time which is needed for drying ink is passed, the sheet is transported again to the inkjet recording apparatus by a switchback method.

[Patent Document 3] Japanese Laid-Open Patent Application No. 2000-001010

However, as described above, in a case where a sheet is transported by a transport belt to which an electric charge is applied by being attached thereto, when a part of the tip of the sheet is curled, since the part of the tip of the sheet does not contact the transport belt closely, the electrostatic force between the part of the tip of the sheet and the transport belt becomes small.

Especially, in a low humidity environment, in a case where both sides printing is executed on a sheet, when an image is formed on the first side of the sheet by ejecting recording liquid, curling of the sheet occurs due to rapidly absorbing water. The curling occurrence on the sheet is different in a relationship between the sheet carrying (transporting) direction and the grain direction of the sheet. In short grain carrying in which the sheet carrying direction crosses the grain direction of sheet, the tip and the end of the sheet contact the transport belt and the center part of the sheet is separated from the transport belt in the sheet carrying direction. In long grain carrying in which the sheet carrying direction is the same direction as the grain direction of sheet, both side edges of the sheet contact the transport belt and the center part of the sheet is separated from the transport belt in the direction which crosses the sheet carrying direction.

Therefore, in a case where the both sides printing is executed, when the sheet is transported to an image forming region in which the recording head is disposed so as to print an image on the second side of the sheet, a part of the sheet which is separated from the transport belt rubs the nozzle surface of the recording head due to the curling of the sheet. Consequently, the image on the sheet may be degraded and jamming may occur.

SUMMARY

In an aspect of this disclosure, there is provided an image forming apparatus which prevents degradation of an image on a sheet and occurrence of jamming when both sides printing is executed.

In another aspect of this disclosure, there is provided an image forming apparatus, wherein when an image is printed on a first side of a sheet and an image is to be printed on a second side of the sheet, the apparatus stops the transportation of the sheet to the image forming unit after the image is formed on the first side of the sheet and before the image is formed on the second side of the sheet until at least the tip of the second side of the sheet is not apart from the transport belt.

In addition, it is preferable that at least one of stopping necessity of the sheet on whose first side the image is printed and a stopping time of the sheet to be transported to the image forming unit be determined.

In addition, it is preferable that at least one of the stopping necessity of the sheet and the stopping time of the sheet be determined based on information of the image which is printed on the first side of the sheet.

In addition, it is preferable that the information of the image be at least any one of an printing area of the image on the total area of the first side of the sheet, image density of the image on the total area of the first side of the sheet, proportions among different size ink droplets of the image on the first side of the sheet, distribution of image printing parts of the image on the total area of the first side of the sheet, an image printing rate on the total area and an image printing rate on the back end part of the image on the first side of the sheet, and the image printing rate on the total area and a weighted image printing rate on the back end part of the image on the first side of the sheet. Further, it is preferable that a weighting factor for the weighted image printing rate be a variable.

In addition, it is preferable that at least one of the stopping necessity of the sheet and the stopping time of the sheet be determined based on the number of ink droplets ejected on the first side of the sheet.

In this case, it is preferable that the number of ink droplets ejected on the first side of the sheet be any one of the number of ink droplets ejected on the total area and the number of ink droplets ejected on the back end part of the first side of the sheet, and the number of ink droplets ejected on the total area and the weighted number of ink droplets ejected on the back end part of the first side of the sheet. Further, it is preferable that a weighting factor for the weighted number of ink droplets be a variable.

In addition, it is preferable that at least one of the stopping necessity of the sheet and the stopping time of the sheet be determined based on the type of the sheet.

In addition, it is preferable that at least one of the stopping necessity of the sheet and the stopping time of the sheet be determined based on temperature and/or humidity.

In this case, it is preferable that at least one temperature and humidity detecting unit be disposed in a sheet feeding section which feeds the sheet, a belt guiding member which guides a transport belt, or a carriage which transports a recording head disposed in the image forming unit.

In addition, it is preferable that at least one of the stopping necessity of the sheet and the stopping time of the sheet be determined based on a combination of at least two of information of the image which is printed on the first side of the sheet, the number of ink droplets ejected on the first side of the sheet, the type of the sheet, and temperature and/or humidity.

In addition, it is preferable that a first pushing roller be disposed to face a carrying roller which transports the transport belt for pushing the sheet to the transport belt. The sheet is stopped so that the tip of the sheet is sandwiched between the first pushing roller and the transport belt.

In addition, it is preferable that a second pushing roller be disposed right before the image forming unit to push the sheet to the transport belt. The sheet is stopped so that the tip of the sheet is sandwiched between the second pushing roller and the transport belt.

EFFECT OF THE INVENTION

In an aspect of this disclosure, when an image is printed on a first side of a sheet and an image is to be printed on a second side of the sheet, the apparatus stops the transportation of the sheet to the image forming unit after the image is formed on the first side of the sheet and before the image is formed on the second side of the sheet until at least the tip of the second side of the sheet is not apart from the transport belt. Therefore, when the image is printed on the second side of the sheet, curling of the sheet can be decreased and degradation of the image can be prevented and occurrence of jamming can be prevented.

BRIEF DESCRIPTION OF THE DRAWINGS

The above-mentioned and other aspects, features and advantages will become more apparent from the following detailed description when read in conjunction with the accompanying drawings, in which:

FIG. 8 is a flowchart showing both sides printing processes in the image forming apparatus according to a first embodiment of the present invention;

FIG. 9 is a flowchart showing both sides printing processes in the image forming apparatus according to a second embodiment of the present invention;

FIG. 10 is a flowchart showing both sides printing processes in the image forming apparatus according to a third embodiment of the present invention;

FIG. 11 is a flowchart showing both sides printing processes in the image forming apparatus according to a fourth embodiment of the present invention;

FIG. 12 is a flowchart showing both sides printing processes in the image forming apparatus according to a fifth embodiment of the present invention;

FIG. 13 is a flowchart showing both sides printing processes in the image forming apparatus according to a sixth embodiment of the present invention;

FIG. 14 is a flowchart showing both sides printing processes in the image forming apparatus according to a seventh embodiment of the present invention;

FIG. 15 is a flowchart showing both sides printing processes in the image forming apparatus according to an eighth embodiment of the present invention;

FIG. 16 is a flowchart showing both sides printing processes in the image forming apparatus according to a ninth embodiment of the present invention;

FIG. 17 is a flowchart showing both sides printing processes in the image forming apparatus according to a tenth embodiment of the present invention;

FIG. 21 is a flowchart showing both sides printing processes in the image forming apparatus according to a fourteenth embodiment of the present invention;

DESCRIPTION OF THE PREFERRED EMBODIMENTS

Best Mode of Carrying Out the Invention

A best mode of carrying out the present invention is described with reference to the accompanying drawings.

First, referring to FIGS. 1 through 5, an image forming apparatus according to an embodiment of the present invention is described.

Figure 1:
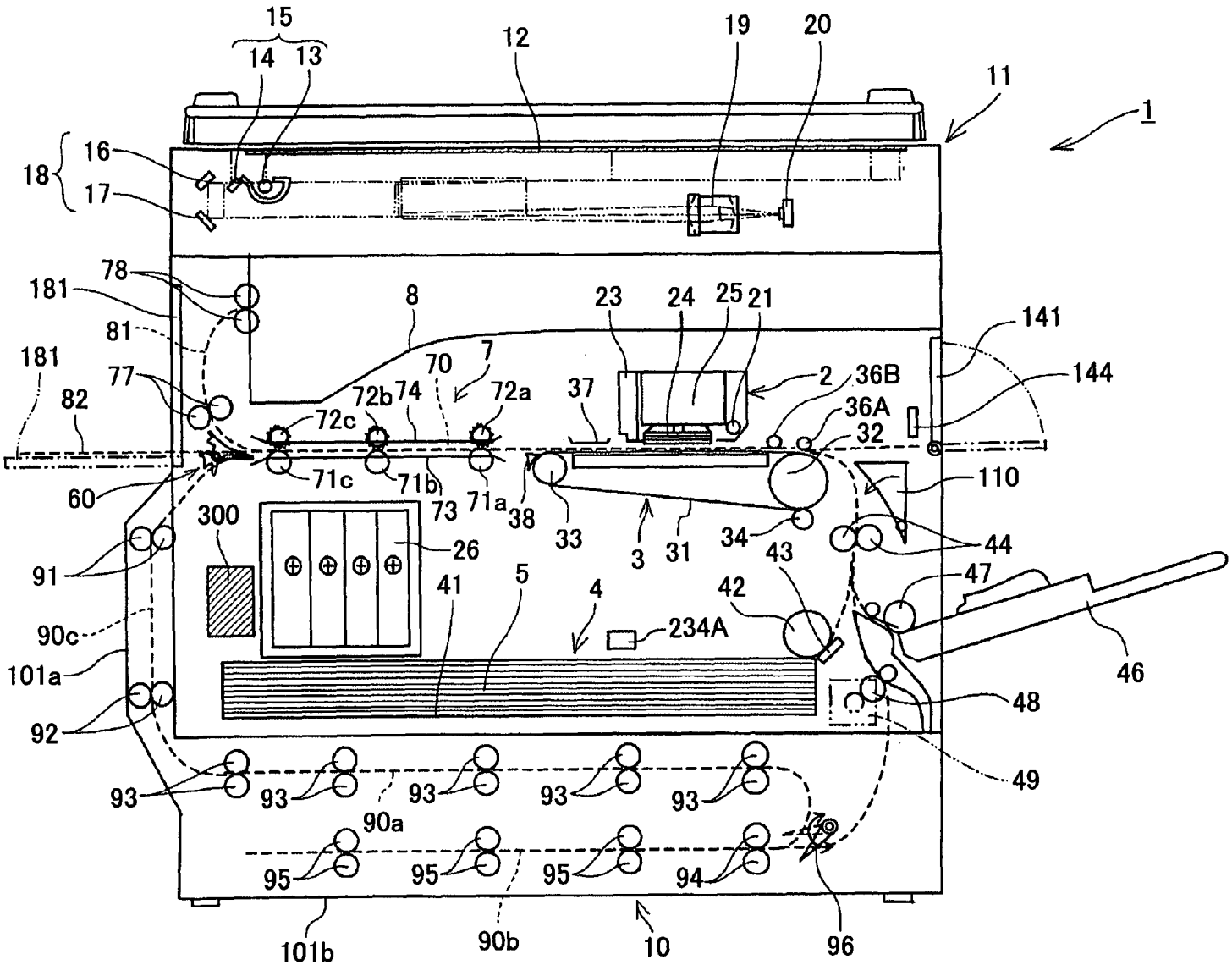
FIG. 1 is a schematic diagram showing a structure of an image forming apparatus according to an embodiment of the present invention.
Figure 2:
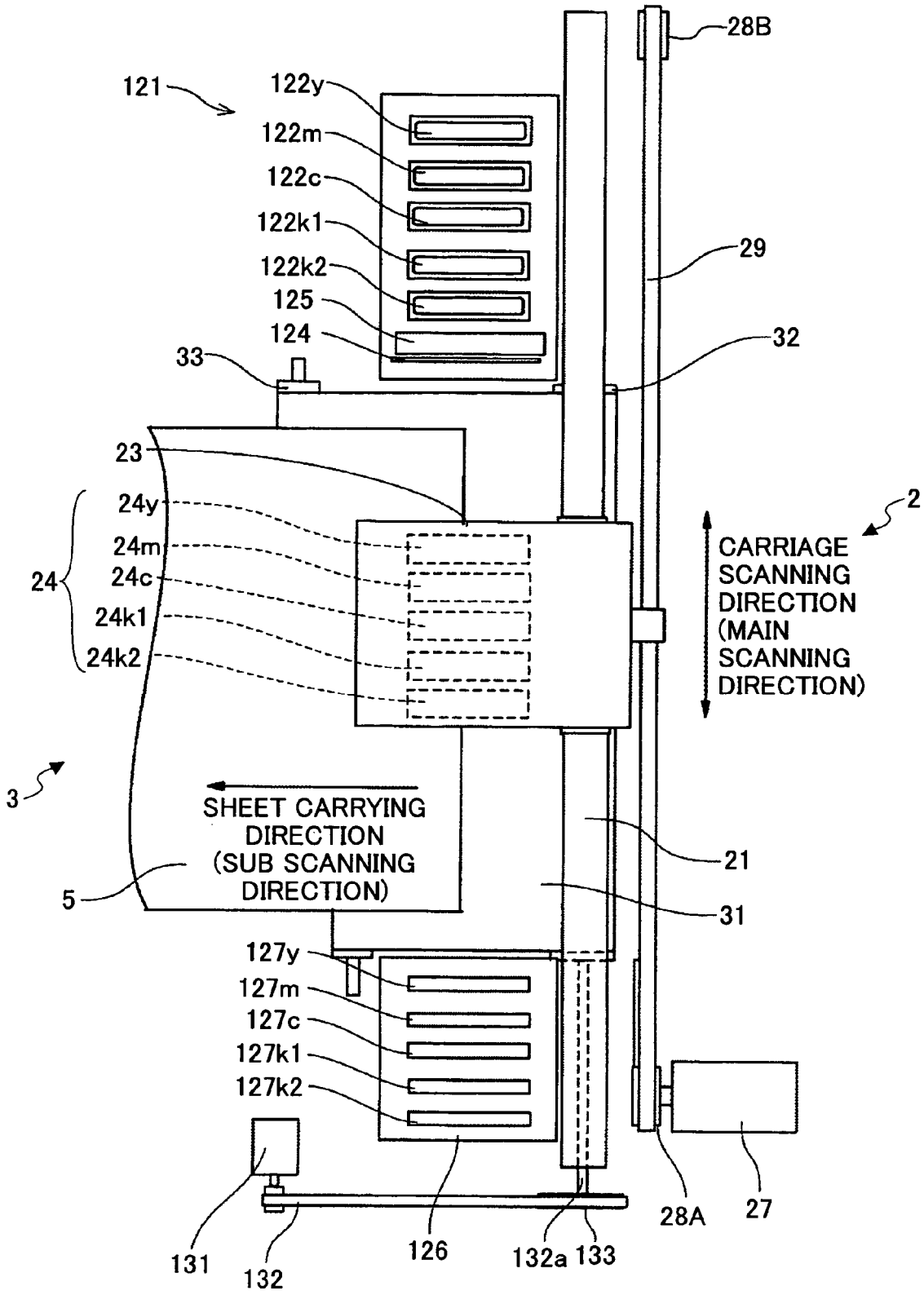
FIG. 2 is a plan view of an image forming section and a sub scanning direction sheet carrying section in the image forming apparatus shown in FIG. 1.
Figure 3:
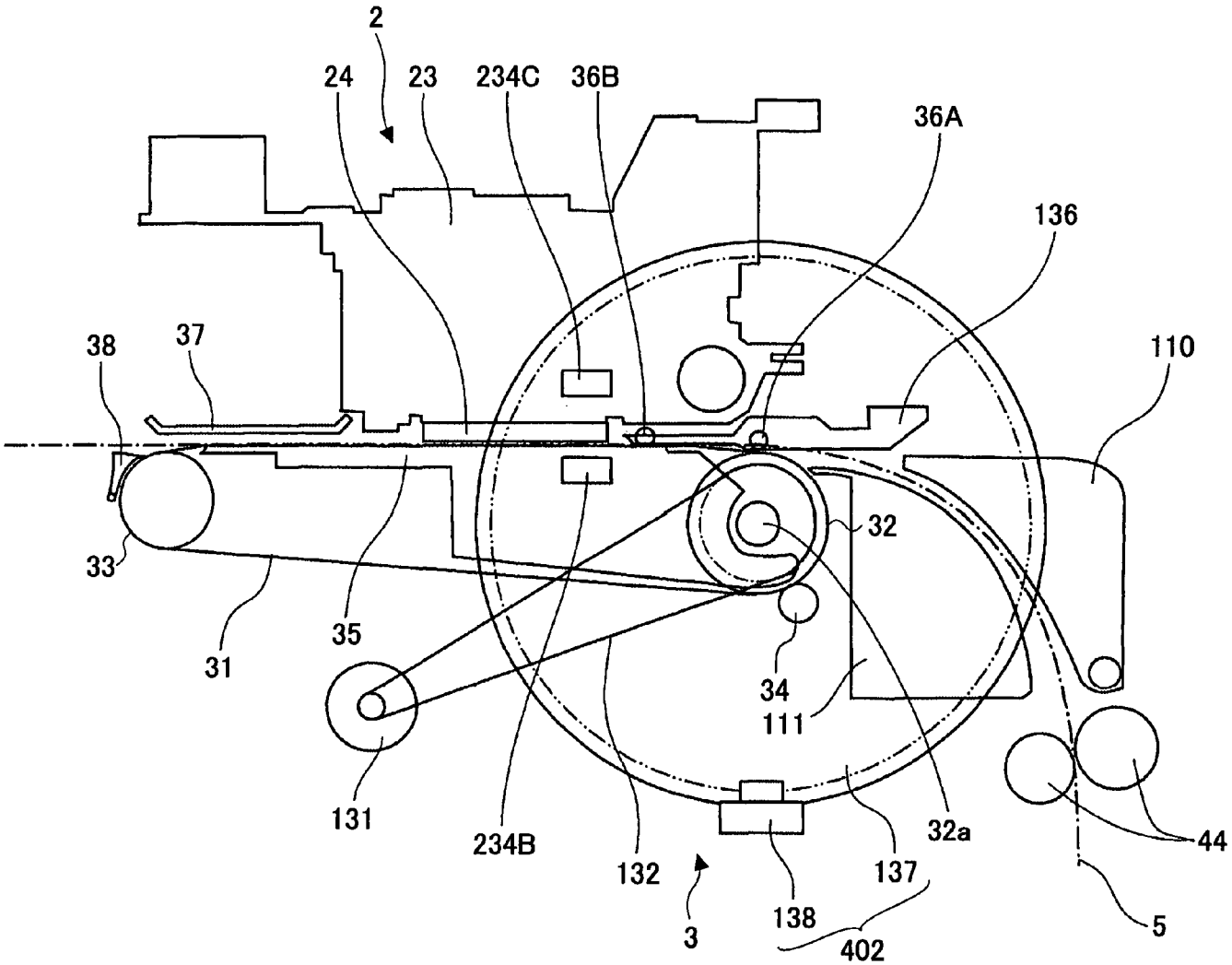
FIG. 3 is a side view of the image forming section and the sub scanning direction sheet carrying section shown in FIG. 2.
Figure 4:
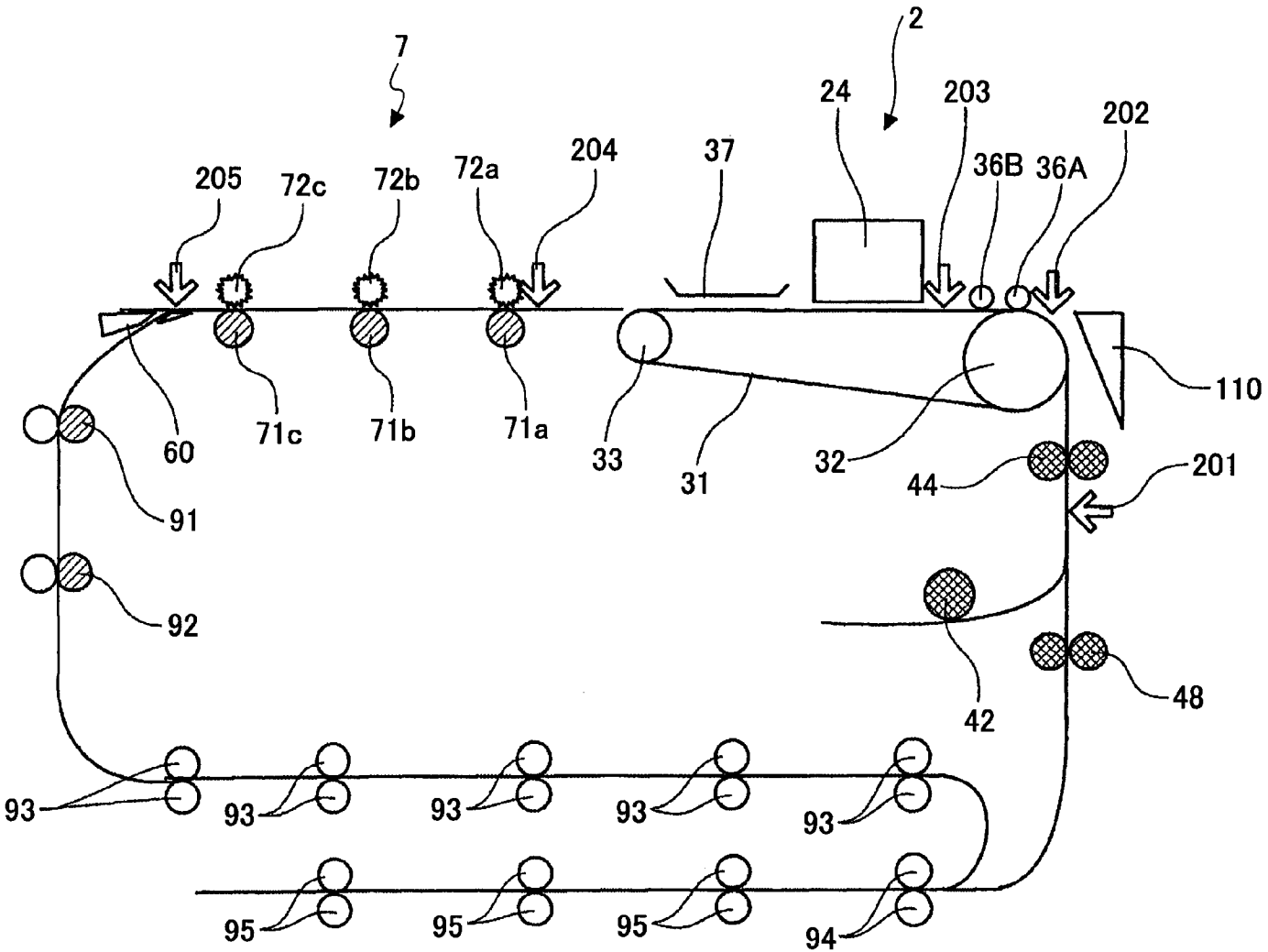
FIG. 4 is a schematic diagram showing sheet carrying routes in both sides printing according to the embodiment of the present invention.
Figure 5:
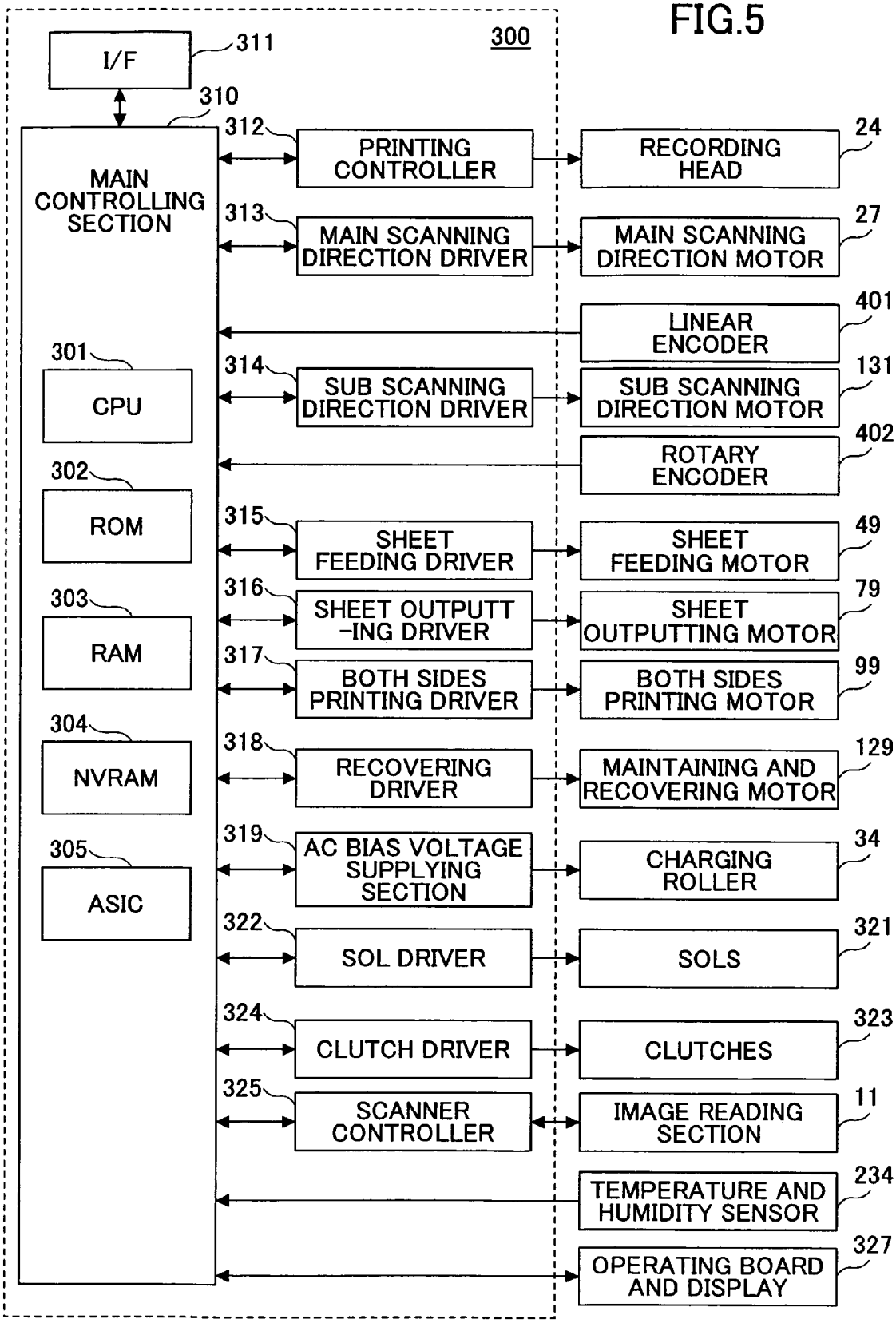
FIG. 5 is a block diagram showing a controller in the image forming apparatus according to the embodiment of the present invention.

FIG. 1 is a schematic diagram showing a structure of the image forming apparatus according to the embodiment of the present invention. FIG. 2 is a plan view of an image forming section and a sub scanning direction sheet carrying section in the image forming apparatus shown in FIG. 1. FIG. 3 is a side view of the image forming section and the sub scanning direction sheet carrying section shown in FIG. 2. FIG. 4 is a schematic diagram showing sheet carrying routes in both sides printing according to the embodiment of the present invention. FIG. 5 is a block diagram showing a controller in the image forming apparatus according to the embodiment of the present invention. In FIG. 1, a multifunctional image forming apparatus is shown.

The image forming apparatus provides an image forming section 2 (image forming unit) that forms an image on a sheet (recording medium) and a sub scanning direction sheet carrying section 3 that transports a sheet in an apparatus main body 1. In the image forming apparatus, each sheet 5 is fed from a sheet feeding section 4 including sheet feeding cassettes disposed on the bottom face of the apparatus main body 1. The sheet 5 is transported by the sub scanning direction sheet carrying section 3 to the position facing the image forming section 2, and an image is formed (recorded) on the sheet 5 by ejecting ink droplets on the sheet 5 by the image forming section 2. In a case of one side printing, the sheet 5 is output on a sheet outputting tray 8 disposed at the upper side of the apparatus main body 1 via a sheet outputting section 7. In a case of both sides printing, the sheet 5 is sent to an image forming (printing) on both sides unit 10 disposed at the bottom side of the apparatus main body 1 from the middle of the sheet outputting section 7. A switchback is applied to the sheet 5, the sheet 5 is fed to the sub scanning direction sheet carrying section 3 again, and the sheet 5 on whose both sides images are formed is output on the sheet outputting tray 8.

In addition, the image forming apparatus provides an image reading section 11 (scanner) for reading an image above the sheet outputting tray 8 in the apparatus main body 1, as an image data (printing data) inputting section for forming an image by the image forming section 2. In the image reading section 11, an image of a manuscript placed on a contact glass 12 is read by moving a first scanning optical unit 15 including a light source 13 and a mirror 14 and a second scanning optical unit 18 including mirrors 16 and 17. The scanned (read) manuscript image is read as image signals by an image reading element 20 disposed behind a lens 19. The read image signals are digitized, the digitized signals are processed, and the processed signals are printed as an image.

As shown in FIG. 2, the image forming section 2 of the image forming apparatus movably holds one side of a carriage 23 in the main scanning direction by a guide rod 21 and a guide rail (not shown) and scans the sheet 5 by moving the carriage 23 in the main scanning direction via a timing belt 29 that is wound around a driving pulley 28A and a driven pulley 28B by the drive of a main scanning direction motor 27.

A recording head 24 composed of ink droplet ejecting heads each of which heads ejects a different color ink droplet is installed on the carriage 23. An image is formed on the sheet 5 by moving the carriage 23 in the main scanning direction and carrying the sheet 5 in the sheet carrying direction (sub scanning direction) by the sub scanning direction sheet carrying section 3 while causing the recording head 24 to eject ink droplets. That is, the image forming apparatus is a shuttle type. In this, an image forming apparatus of a line head type can be also used.

The recording head 24 is composed of two ink droplet ejecting heads 24*k*1 and 24*k*2 that eject black ink (Bk), an ink droplet ejecting head 24*c* that ejects cyan ink (C), an ink droplet ejecting head 24*m* that ejects magenta ink (M), and an ink droplet ejecting head 24*y* that ejects yellow ink (Y). In this, when color is not referred to, the recording head 24 is used to represent the five ink droplet ejecting heads. Each color ink is supplied from a corresponding sub tank 25 (FIG. 1) installed in the carriage 23 for the corresponding ink droplet ejecting head 24*k*1 through 24*y*.

As shown in FIG. 1, ink cartridges 26 that are recording liquid cartridges in which corresponding black, cyan, magenta, and yellow ink is contained are removably attached to an ink cartridge storing section from the front of the apparatus main body 1. Color ink is supplied to the corresponding sub tank 25 for each color from the corresponding ink cartridge 26. In the image forming apparatus, the black ink is supplied to two sub tanks from one ink cartridge 26.

In the recording head 24, as a pressure generator (actuator) that applies pressure to ink in an ink flowing route (pressure generating chamber), there are a piezoelectric type pressure generator, a thermal type pressure generator, an electrostatic type pressure generator, and so on. In the piezoelectric type pressure generator, ink droplets are ejected by changing the volume of the ink flowing route with deformation of vibration plates by which the walls of the ink flowing route are formed by using a piezoelectric element. In the thermal type pressure generator, the ink droplets are ejected by pressure of bubbles generated by heated ink in the ink flowing route by using a heating resistor. In the electrostatic type pressure generator, vibration plates by which the walls of the ink flowing route are formed are positioned to face electrodes, and the ink droplets are ejected by changing the volume of the ink flowing route with deformation of the vibration plates by an electrostatic force generated between the vibration plates and the electrodes. Any one of them can be used in the embodiment of the present invention.

In addition, as shown in FIG. 2, in a non-printing region located at one side in the scanning direction of the carriage 23 in the apparatus main body 1, a nozzle maintaining and recovering unit 121 which maintains normal conditions of nozzles of the recording head 24 and recovers from abnormal conditions thereof is disposed. The nozzle maintaining and recovering unit 121 provides five humidity keeping caps 122*k*1, 122*k*2, 122*c*, 122*m*, and 122*y* for capping nozzle faces of the corresponding five recording heads 24*k*1, 24*k*2, 24*c*, 24*m*, and 24*y*, a suction cap (not shown), a wiper blade 124 for wiping the nozzle faces of the recording head 24, and a remaining ink droplet receiving member 125 for receiving ink droplets which do not contribute to forming an image. In this, when color is not referred to, a humidity keeping cap 122 is used to represent the five humidity keeping caps.

Further, as shown in FIG. 2, in a non-printing region located at the other side in the scanning direction of the carriage 23 in the apparatus main body 1, a remaining ink droplet receiving member 126 for receiving ink droplets which do not contribute to forming an image from the five recording heads 24 is provided. The remaining ink droplet receiving member 126 provides five openings 127*k*1, 127*k*2, 127*c*, 127*m*, and 127*y* for the five recording heads 24. In this, when color is not referred to, an opening 127 is used to represent the five openings.

As shown in FIGS. 1 through 3, the sub scanning direction sheet carrying section 3 provides a carrying roller 32 which is a driving roller, a driven roller 33 which is a tension roller, a transport belt 31, a charging roller 34, a guiding member 35, first and second pushing rollers 36A and 36B, a guiding plate 37, and a sheet separating claw 38. The carrying roller 32 transports the sheet 5 fed from the sheet feeding section 4 by changing the carrying direction by approximately 90 degrees to face the image forming section 2. The transport belt 31 is an endless belt which is wound around the carrying roller 32 and the driven roller 33. The charging roller 34 applies a high alternating voltage from a high voltage power source to the transport belt 31 so that the face of the transport belt 31 is charged. The guiding member 35 guides the transport belt 31 at the region facing the image forming section 2. The first pushing roller 36A pushes the sheet 5 onto the transport belt 31 at the position facing the carrying roller 32 by being rotatably held by a holding member 136. The second pushing roller 36B pushes the sheet 5 onto the transport belt 31 at the position right before the recording head 24 by being rotatably held by the holding member 136. The guiding plate 37 pushes the upper surface of the sheet 5 on which an image is formed by the image forming section 2. The sheet separating claw 38 separates the sheet 5 on which the image is formed from the transport belt 31.

The carrying roller 32 is rotated by a sub scanning direction motor 131 that is a DC brushless motor via a timing belt 132 and a timing roller 133 (FIG. 2); with this, the transport belt 31 of the sub scanning direction sheet carrying section 3 is rotatably moved in the sheet carrying direction (sub scanning direction). The transport belt 31 has a double-layered structure which has a front layer that is a sheet attaching face formed of pure resin, for example, an ETFE pure material, to which rheostatic control is not applied and a back layer (ground layer) formed of the same material as the front layer to which rheostatic control is applied by carbon. However, the transport belt 31 is not limited to the above structure and is able to have a single layer or a three-layered structure.

In addition, a cleaning unit (not shown, made of Mylar (a trademark)) for removing sheet powders and so on attached to the front face of the transport belt 31 and a discharging brush (not shown) for discharging electric charges on the front surface of the transport belt 31 are disposed between the driven roller 33 and the charging roller 34.

Further, an encoder wheel 137 having high resolution is attached to an axle 32*a* of the carrying roller 32, and an encoder sensor 138 formed by a transmission type photosensor for detecting a slit (not shown) formed in the encoder wheel 137 is disposed; with this, a rotary encoder is formed by the encoder wheel 137 and the encoder sensor 138.

The sheet feeding section 4 is removable from the front of the apparatus main body 1, and provides sheet feeding cassettes 41 in each of which many pieces of sheet 5 are stored; a sheet feeding roller 42 and a friction pad 43 that feed the sheet 5 by picking up each sheet 5 from the sheet feeding cassette 41; and a pair of registration rollers 44 that executes registration of the fed sheet 5.

In addition, the sheet feeding section 4 provides a manually sheet feeding tray 46 in which many pieces of sheet 5 are stored, a sheet feeding roller 47 that feeds the sheet 5 by picking up each sheet 5 from the manually sheet feeding tray 46, a carrying roller 48 that transports the sheet 5 fed from another sheet feeding cassette (not shown), which is installed under the apparatus main body 1 as an option, and from the duplex print unit 10. Rollers such as the sheet feeding roller 42, the registration rollers 44, the sheet feeding roller 47, and the carrying roller 48, which feed the sheet 5 to the sub scanning direction sheet carrying section 3, are rotatably driven by a sheet feeding motor 49, which is an HD type stepping motor, via an electromagnetic clutch (not shown).

The sheet outputting section 7 provides three sheet outputting rollers 71*a*, 71*b*, and 71*c* (when those are not individually described, they are referred to as a sheet outputting roller 71) that carry the sheet 5 separated by the sheet separation claw 38 of the sub scanning direction sheet carrying section 3, and three spurs 72*a*, 72*b*, and 72*c* (when those are not individually described, they are referred to as a spur 72) that face the sheet outputting roller 71. Further, the sheet outputting section 7 provides a lower guiding section 73 and an upper guiding section 74 that guide the sheet 5 being transported between the sheet outputting roller 71 and the spur 72, and sheet reversing rollers 77 and reversed sheet outputting rollers 78 that carry the sheet 5 fed between the lower guiding section 73 and the upper guiding section 74 to the sheet outputting tray 8 via a reversed sheet outputting route 81, which is a first sheet outputting route, in which the sheet 5 is reversed. In this, a carrying route, which transports the sheet 5 between the lower guiding section 73 and the upper guiding section 74, is called a carrying route 70.

At the outputting side of the carrying route 70, a branching mechanism 60 is disposed. The branching mechanism changes a route to any one of the first sheet outputting route 81 for reversing and outputting the sheet 5 to the sheet outputting tray 8, a second sheet outputting route 82 for outputting the sheet 5 to a sheet straight outputting tray 181 (described below), and a sheet outputting route (both sides forming route) for sending the sheet 5 to the duplex print unit 10.

The duplex print unit 10 provides a sheet vertically carrying route 101*a* which includes a vertically carrying route 90*c* that transports the sheet 5 output from the branching mechanism 60 downward and a sheet horizontally carrying route 101*b* which includes a horizontally carrying route 90*a* and a switchback carrying route 90*b* which carry the sheet 5 sent from the vertically carrying route 90*c*.

The vertically carrying route 90*c* provides input rollers 91 which carry the sheet 5 sent in the vertically carrying route 90*c* downward and output rollers 92 which send the sheet 5 to the horizontally carrying route 90*a*. The horizontally carrying route 90*a* provides five pairs of carrying rollers 93, and the switch back carrying route 90*b* provides a pair of both sides output rollers 94 and three pairs of both sides carrying rollers 95 which reverse the sheet 5 fed from the horizontally carrying route 90*a* and feed the reversed sheet 5.

In addition, the sheet horizontally carrying route 101*b* provides a branching plate 96, which changes over a carrying route of the sheet 5 sent from the horizontally carrying route 90*a* to the switchback carrying route 90*b* and changes over a carrying route from the switchback carrying route 90*b* to the carrying roller 48 so that the branching plate 96 can swing through an arc. The branching plate 96 can swing between a switchback side position shown by a continuous line in FIG. 1 and a re-supplying side position shown by a broken line in FIG. 1.

The sheet 5 output from the duplex print unit 10 is transported to the registration rollers 44 via the carrying roller 48.

In addition, in order to prevent a back force from being applied to the sheet 5 by forming a loop in the sheet 5 between the carrying roller 32 and the first and second pushing rollers 36A and 36B of the sub scanning direction sheet carrying section 3 and the registration rollers 44, when the sheet 5 fed from the sheet feeding cassette 41 in the sheet feeding section 4, the manually sheet feeding tray 46, or the duplex print unit 10 is transported by the registration rollers 44, a switching guide plate 110 is disposed to face a guiding member 111 (FIG. 3) in the apparatus main body 1 so that the switching guide plate 110 can swing.

When the sheet 5 is transported from the registration rollers 44 to the sub scanning direction sheet carrying section 3, the switching guide plate 110 guides the sheet 5 by swinging from the position shown in FIG. 1 in the arrow direction, and the switching guide plate 110 returns to the position shown in FIG. 1 at the timing when the sheet 5 reaches the sub scanning direction sheet carrying section 3 which causes the sheet 5 to form a loop therein.

In addition, in the image forming apparatus, in order to manually feed a piece of sheet, as shown in FIG. 1, one sheet manually feeding tray 141 is disposed in one side of the apparatus main body 1 so that the one sheet manually feeding tray 141 can be opened and closed. When a piece of sheet is fed, the one sheet manually feeding tray 141 is opened to the position shown by a two-dot chain line. The sheet 5 fed from the one sheet manually feeding tray 141 can be inserted straight between the carrying roller 32 and the first and second pushing rollers 36A and 36B (FIG. 3) of the sub scanning direction sheet carrying section 3 by being guided by the upper surface of the switching guide plate 110.

Further, in order to straightly output the sheet 5 in a face-up state on which an image is formed by being applied to the one piece of sheet manually fed, the sheet straight outputting tray 181 is disposed in the other side of the apparatus main body 1 so that the sheet straight outputting tray 181 can be opened and closed. When the sheet straight outputting tray 181 is opened, the sheet straight outputting route 82 is formed. The sheet straight outputting route 82 is the second sheet outputting route, which outputs the sheet 5 fed from between the lower guiding section 73 and the upper guiding section 74 of the sheet outputting section 7 straight to the sheet straight outputting tray 181.

Therefore, when a thick medium is used such as an OHP sheet or a thick sheet which is difficult to be transported in a curved route, the medium can be transported straight from the one sheet manually feeding tray 141 to the sheet straight outputting tray 181. In this, a normal sheet can be transported straight from the one sheet manually feeding tray 141 to the sheet straight outputting tray 181.

Next, referring to FIG. 4, sensor positions in the sheet carrying routes are described. In order to detect the sheet 5, a registration sensor 201 is disposed at the upstream side of the registration rollers 44, and a printing section entrance sensor 202 is disposed before the carrying roller 32 and the first pushing roller 36A. Further, in order to register the image writing start position, an image registration sensor 203 is disposed at the entrance side of the image forming section 2 (the downstream side of the second pushing roller 36B). In addition, a printing section exit sensor 204 is disposed at the exit side of the image forming section 2 (before the sheet outputting roller 71*a*) and a branching sensor 205 is disposed at the exit side of the sheet outputting section 7.

Next, referring to FIG. 5, the controller of the image forming apparatus is described. A controller 300 of the image forming apparatus provides a main controlling section 310. The main controlling section 310 includes a CPU 301, a ROM 302, a RAM 303, a non-volatile memory NVRAM 304, and an ASIC (application specific integrated circuit) 305. The ROM 302 stores programs which are operated by the CPU 301 and other data. The RAM 303 temporarily stores image data and so on. The NVRAM 304 stores data even when a power source of the apparatus is cut off. The ASIC 305 executes signal processing for the image data, image processing to arrange the image data, and signal processing for input and output signals for controlling the sections in the controller 300.

In addition, the controller 300 provides an interface (I/F) 311 for receiving/transmitting data and signals from/to a host apparatus (not shown) disposed between the main controlling section 310 and the host apparatus. Further, the controller 300 provides a printing controller 312 including a head driver for driving and controlling the recording head 24, a main scanning direction driver 313 (motor driver) for driving the main scanning direction motor 27 which moves the carriage 23, and a sub scanning direction driver 314 for driving the sub scanning direction motor 131. In addition, the controller 300 provides a sheet feeding driver 315 for driving the sheet feeding motor 49, a sheet outputting driver 316 for driving a sheet outputting motor 79 which drives the rollers in the sheet outputting section 7, a both sides printing driver 317 for driving a both sides printing motor 99 which drives the rollers in the duplex print unit 10, a recovering driver 318 for driving a maintaining and recovering motor 129 which drives the nozzle maintaining and recovering unit 121, and an AC bias voltage supplying section 319 for supplying an AC bias voltage to the charging roller 34.

In addition, the controller 300 provides an SOL driver 322 for driving various SOLs (solenoids), a clutch driver 324 for driving clutches 323, and a scanner controller 325 for controlling the image reading section 11.

In addition, a signal detected by a temperature and humidity sensor 234 which detects temperature and humidity surrounding the transport belt 31 is input to the main controlling section 310. Signals detected by sensors (not shown) are input to the main controlling section 310; however, the sensors and the signals are omitted in FIG. 5. The main controlling section 310 controls an operating board and display 327. The operating board and display 327 includes keys such as a tenkey and a print starting key and a display disposed in the apparatus main body 1. The main controlling section 310 receives signals from the operating board and display 327 and displays information on the operating board and display 327.

A signal (pulse) output from a rotary encoder 402 composed of the encoder wheel 137 and the encoder sensor (photo sensor) 138 is input to the main controlling section 310. The main controlling section 310 moves the transport belt 31 via the carrying roller 32 by driving the sub scanning direction motor 131 via the sub scanning direction driver 314 based on the pulse.

Next, image forming operations in the image forming apparatus are briefly described. A high alternating voltage composed of positive and negative rectangular pulses is applied to the charging roller 34 from the AC bias voltage supplying section 319. Since the charging roller 34 contacts the insulation layer (front surface) of the transport belt 31, positive electric charges and negative electric charges are alternately applied to the front surface of the transport belt 31 at predetermined widths with belt shapes along the carrying direction, and a non-uniform electric field is formed on the transport belt 31 due to its being charged.

The sheet 5 is transported on the transport belt 31 at the position between the carrying roller 32 and the first pushing roller 36A from a section such as the sheet feeding section 4, the manually sheet feeding tray 46, the duplex print unit 10, and the one sheet manually feeding tray 141. A non-uniform electric field is formed on the transport belt 31 at the position by the positive and negative electric charges. The sheet 5 is transported by the movement of the transport belt 31 by being attached onto the transport belt 31 by an electrostatic attraction force.

While the sheet 5 is intermittently transported by the transport belt 31, ink droplets of recoding liquid are ejected from the recording head 24 on the sheet 5 based on print data, and an image is formed on the sheet 5. The tip of the sheet 5 on which the image is formed is separated from the transport belt 31 by the sheet separating claw 38 and the sheet 5 is output to the sheet outputting tray 8, the sheet straight outputting tray 181, or the duplex print unit 10 by the sheet outputting section 7. Another image is formed on the back surface of the sheet 5 output from the duplex print unit 10 and the sheet 5 is output.

Figure 6:
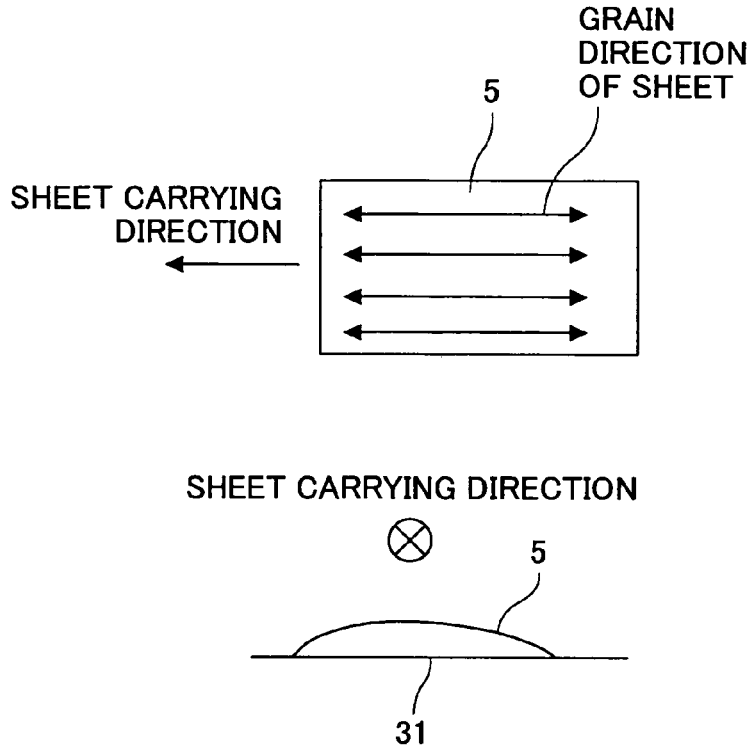
FIG. 6 is a diagram explaining curling of sheet in a relationship between the sheet carrying direction and the grain direction of sheet.
Figure 7:
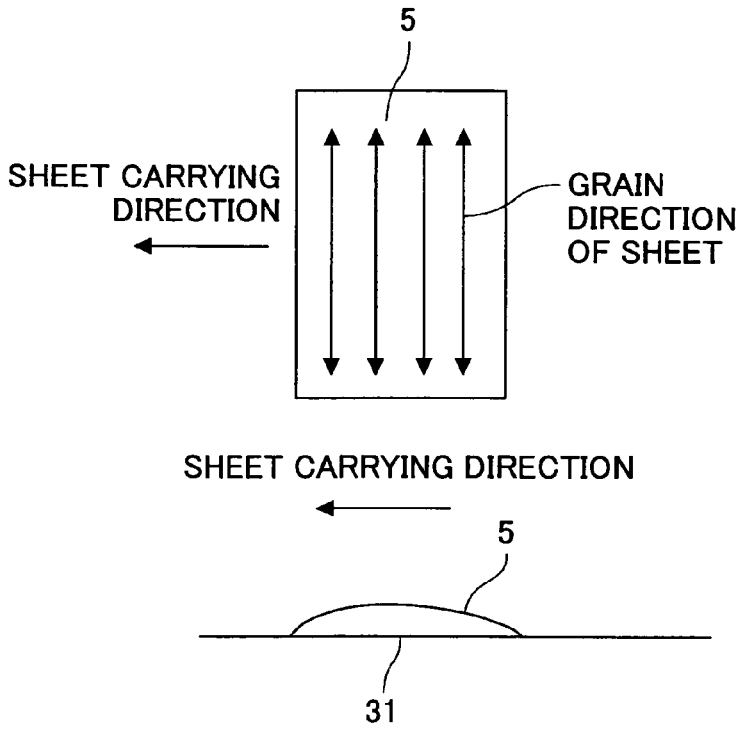
FIG. 7 is a diagram explaining curling of sheet in another relationship between the sheet carrying direction and the grain direction of sheet.

Next, referring to FIGS. 6 and 7, curling of the sheet 5 on whose first side an image is printed is described. FIG. 6 is a diagram explaining curling of sheet in a relationship between the sheet carrying direction and the grain direction of sheet. FIG. 7 is a diagram explaining curling of sheet in another relationship between the sheet carrying direction and the grain direction of sheet.

As shown in FIG. 6(*a*), when the sheet 5 is transported by the long grain carrying in which the sheet carrying direction is the same as the grain direction of the sheet 5, as shown in FIG. 6(*b*), both side edges of the sheet 5 contact the transport belt 31 and the center part of the sheet 5 is separated from the transport belt 31 in the direction which crosses the sheet carrying direction.

On the other hand, as shown in FIG. 7(*a*), when the sheet 5 is transported by the short grain carrying in which the sheet carrying direction crosses the grain direction of the sheet 5, as shown in FIG. 7(*b*), the tip and the end of the sheet 5 contact the transport belt 31 and the center part of the sheet 5 is separated from the transport belt in the sheet carrying direction.

Therefore, in both the cases, in order to print an image on the second side of the sheet 5 on which curling occurs, when the sheet 5 attached onto the transport belt 31 is transported to the image forming region (image forming section 2) where the recording head 24 is disposed by attached onto the transport belt 31, the sheet 5 is transported in a separated state as shown in FIG. 6(*b*) or FIG. 7(*b*). Consequently, a force attaching the sheet 5 to the transport belt 31 is not sufficient at the tip and/or the end of the sheet 5. In this case, interference with the recording head 24 occurs so that an image is degraded and jamming may occur.

FIG. 8 is a flowchart showing both sides printing processes in the image forming apparatus according to a first embodiment of the present invention. Referring to FIG. 8, the both sides printing processes according to the first embodiment of the present invention are described.

When printing an image on a sheet 5 is started, each sheet 5 is fed from, for example, the sheet feeding cassette 41 of the sheet feeding section 4 by driving the sheet feeding motor 49 and the sheet 5 is transported to the image forming section 2.

When both sides printing is executed (YES in S1), image data (information) of an image which is printed on the first side of the sheet 5 are transferred to the printing controller 312 (S2) and the image is printed on the first side of the sheet 5 (S3). Then, it is determined whether the sheet 5 on whose first side the image is printed must be stopped being transported based on the image data of the image which is printed on the first side of the sheet 5 (S4). That is, stopping necessity is determined. When it is determined that the sheet 5 must be stopped after the image is printed on the first side of the sheet 5 (YES in S5), a stopping time is determined based on the image data (S6), and carrying the sheet 5 is stopped so that the sheet 5 is put on standby (S7). After the determined stopping time is passed (YES in S8), the sheet 5 is transported to the image forming region (image forming section 2) in which the recording head 24 is disposed and another image is printed on the second side of the sheet 5 (S9). Then, the sheet 5 is output (S10).

The stopping time is from after printing an image on the first side of the sheet 5 to starting again to carry the sheet 5 to the image forming section 2 when the tip of the second side of the sheet 5 is not separated from the transport belt 31.

The stopping time is determined by stopping necessity based on the image data. However, the stopping necessity can be determined by some conditions, for example, surrounding temperature and humidity, and the stopping time is determined by the image data. On the contrary, the above necessity and the stopping time can be determined in reverse order, or the stopping time can be a fixed time instead of a variable time. The above description can be applied to embodiments described below.

When it is determined that the sheet 5 does not have to be stopped being transported after the image is printed on the first side of the sheet 5 (NO in S5), another image is printed on the second side of the sheet 5 (S9), and the sheet 5 is output (S10).

When the both sides printing is not executed (NO in S1), one side printing is executed and an image is printed on the first side of the sheet 5 and the sheet is output. However, detailed processes of the one side printing are omitted. This is the same in the following embodiments.

As described above, when the both sides printing is executed, after an image is printed on the first side of the sheet 5, starting to carry the second side of the sheet 5 to the image forming region is stopped until the tip of the second side of the sheet 5 becomes not separated from the transport belt 31. With this, curling of sheet 5 can be decreased and the sheet 5 can be tightly attached onto the transport belt 31. Consequently, interference with the recording head 24 can be prevented and degradation of the image quality and jamming can be prevented.

In this case, at least one of the stopping necessity (standby necessity) and the stopping time of the sheet 5 is determined based on the information (image data) of the image which is printed on the first side of the sheet 5. With this, curling of the sheet 5 caused by printing the image on the first side of the sheet 5 can be suitably predicted and also the stopping time can be properly determined. Therefore, in a case where the curling may not occur, an unnecessary stopping process is not needed and lowering both sides printing speed caused by an unnecessary long stopping time can be prevented.

FIG. 9 is a flowchart showing both sides printing processes in the image forming apparatus according to a second embodiment of the present invention. Referring to FIG. 9, the both sides printing processes according to the second embodiment of the present invention are described.

In the second embodiment of the present invention, an printing area (ink droplet adhering area) on the total area of the first side of the sheet 5 is calculated and it is determined whether the sheet 5 is stopped being transported based on the calculated printing area.

The processes are described in detail. When both sides printing is executed (YES in S21), image data of an image which is printed on the first side of the sheet 5 are transferred to the printing controller 312 (S22) and the image is printed on the first side of the sheet 5 (S23). Then, an printing area (ink droplet adhering area) on the total area of the first side of the sheet 5 is calculated based on the image data of the image which is printed on the first side of the sheet 5 (S24). Then, it is determined whether the sheet 5 on whose first side the image is printed must be stopped being transported based on the calculated printing area (S25). That is, stopping necessity is determined. When it is determined that the sheet 5 must be stopped after the image is printed on the first side of the sheet 5 (YES in S25), a stopping time is determined based on the calculated printing area (S26), and carrying the sheet 5 is stopped so that the sheet 5 is put on standby (S27). After the determined stopping time is passed (YES in S28), the sheet 5 is transported to the image forming region (image forming section 2) in which the recording head 24 is disposed and another image is printed on the second side of the sheet 5 (S29). Then, the sheet 5 is output (S30).

In a case where stopping necessity and the stopping time are determined based on the calculated printing area, first, the printing area is calculated, and when the calculated printing area is, for example, a threshold value or more, the stopping necessity is determined, and the stopping time corresponding to the calculated printing area is determined. In this case, a lookup table is formed in which a relationship between the printing area and the stopping time is described. When the stopping time "0" is set, that is, a case where the sheet 5 is not stopped being transported, both of the stopping necessity and the stopping time can be obtained by referring to the lookup table by using the calculated printing area. The lookup table can be applied to embodiments described below.

When it is determined that the sheet 5 does not have to be stopped being transported after the image is printed on the first side of the sheet 5 (NO in S25), another image is printed on the second side of the sheet 5 (S29), and the sheet 5 is output (S30).

As described above, in a case where at least one of the stopping necessity (standby necessity) and the stopping time of the sheet 5 is determined based on the printing area of an image which is printed on the first side of the sheet 5, when the printing area becomes relatively large, curling is likely to occur. Therefore, the curling of the sheet 5 caused by printing the image on the first side of the sheet 5 can be suitably predicted and the stopping time can be properly determined. Consequently, when the curling is not likely to occur, an unnecessary stopping process is not needed and lowering both sides printing speed caused by an unnecessary long stopping time can be prevented.

FIG. 10 is a flowchart showing both sides printing processes in the image forming apparatus according to a third embodiment of the present invention. Referring to FIG. 10, the both sides printing processes according to the third embodiment of the present invention are described.

In the third embodiment of the present invention, image density on the total area of the first side of the sheet 5 is calculated and it is determined whether the sheet 5 is stopped being transported based on the calculated image density.

The processes are described in detail. When both sides printing is executed (YES in S31), image data of an image which is printed on the first side of the sheet 5 are transferred to the printing controller 312 (S32) and the image is printed on the first side of the sheet 5 (S33). Then, image density on the total area of the first side of the sheet 5 is calculated based on the image data of the image which is printed on the first side of the sheet 5 (S34). Then, it is determined whether the sheet 5 on whose first side the image is printed must be stopped being transported based on the calculated image density (S35). That is, stopping necessity is determined. When it is determined that the sheet 5 must be stopped after the image is printed on the first side of the sheet 5 (YES in S35), a stopping time is determined based on the calculated image density (S36), and carrying the sheet 5 is stopped so that the sheet 5 is put on standby (S37). After the determined stopping time is passed (YES in S38), the sheet 5 is transported to the image forming region (image forming section 2) in which the recording head 24 is disposed and another image is printed on the second side of the sheet 5 (S39). Then, the sheet 5 is output (S40).

When it is determined that the sheet 5 does not have to be stopped being transported after the image is printed on the first side of the sheet 5 (NO in S35), another image is printed on the second side of the sheet 5 (S39), and the sheet 5 is output (S40).

As described above, in a case where at least one of the stopping necessity (standby necessity) and the stopping time of the sheet 5 is determined based on the image density on the total area of an image which is printed on the first side of the sheet 5, when the image density becomes relatively large, curling is likely to occur. Therefore, curling of the sheet 5 caused by printing the image on the first side of the sheet 5 can be suitably predicted and the stopping time can be properly determined. Consequently, when the curling is not likely to occur, an unnecessary stopping process is not needed and lowering both sides printing speed caused by an unnecessary long stopping time can be prevented.

FIG. 11 is a flowchart showing both sides printing processes in the image forming apparatus according to a fourth embodiment of the present invention. Referring to FIG. 11, the both sides printing processes according to the fourth embodiment of the present invention are described.

In the fourth embodiment of the present invention, proportions among different size ink droplets which are used for printing an image on the first side of the sheet 5 are calculated and it is determined whether the sheet 5 is stopped being transported based on the calculated proportions.

The processes are described in detail. When both sides printing is executed (YES in S41), image data of an image which is printed on the first side of the sheet 5 are transferred to the printing controller 312 (S42) and the image is printed on the first side of the sheet 5 (S43). Then, proportions among different size ink droplets which are used for printing the image on the first side of the sheet 5 are calculated based on the image data of the image which is printed on the first side of the sheet 5 (S44). Then, it is determined whether the sheet 5 on whose first side the image is printed must be stopped being transported based on the calculated proportions (S45). That is, stopping necessity is determined. When it is determined that the sheet 5 must be stopped after the image is printed on the first side of the sheet 5 (YES in S45), a stopping time is determined based on the calculated proportions (S46), and carrying the sheet 5 is stopped so that the sheet 5 is put on standby (S47). After the determined stopping time is passed (YES in S48), the sheet 5 is transported to the image forming region (image forming section 2) in which the recording head 24 is disposed and another image is printed on the second side of the sheet 5 (S49). Then, the sheet 5 is output (S50).

When it is determined that the sheet 5 does not have to be stopped being transported after the image is printed on the first side of the sheet 5 (NO in S45), another image is printed on the second side of the sheet 5 (S49), and the sheet 5 is output (S50).

As described above, in a case where at least one of the stopping necessity (standby necessity) and the stopping time of the sheet 5 is determined based on the proportions among different size ink droplets which are used for printing the image on the first side of the sheet 5, when relatively large size ink droplets are used, curling is likely to occur. Therefore, curling of the sheet 5 caused by printing the image on the first side of the sheet 5 can be suitably predicted and also the stopping time can be properly determined. Consequently, when the curling is not likely to occur, an unnecessary stopping process is not needed and lowering both sides printing speed caused by an unnecessary long stopping time can be prevented.

FIG. 12 is a flowchart showing both sides printing processes in the image forming apparatus according to a fifth embodiment of the present invention. Referring to FIG. 12, the both sides printing processes according to the fifth embodiment of the present invention are described.

In the fifth embodiment of the present invention, distribution of image printing parts on the total area of the sheet 5 on whose first side an image is printed is calculated and it is determined whether the sheet 5 is stopped being transported based on the calculated distribution.

The processes are described in detail. When both sides printing is executed (YES in S51), image data of an image which is printed on the first side of the sheet 5 are transferred to the printing controller 312 (S52) and the image is printed on the first side of the sheet 5 (S53). Then, distribution of image printing parts on the total area of the sheet 5 on whose first side an image is printed is calculated based on the image data of the image which is printed on the first side of the sheet 5 (S54). Then, it is determined whether the sheet 5 on whose first side the image is printed must be stopped being transported based on the calculated distribution (S55). That is, stopping necessity is determined. When it is determined that the sheet 5 must be stopped after the image is printed on the first side of the sheet 5 (YES in S55), a stopping time is determined based on the calculated distribution (S56), and carrying the sheet 5 is stopped so that the sheet 5 is put on standby (S57). After the determined stopping time is passed (YES in S58), the sheet 5 is transported to the image forming region (image forming section 2) in which the recording head 24 is disposed and another image is printed on the second side of the sheet 5 (S59). Then, the sheet 5 is output (S60).

When it is determined that the sheet 5 does not have to be stopped being transported after the image is printed on the first side of the sheet 5 (NO in S55), another image is printed on the second side of the sheet 5 (S59), and the sheet 5 is output (S60).

As described above, in a case where at least one of the stopping necessity (standby necessity) and the stopping time of the sheet 5 is determined based on the distribution of image printing parts on the total area of the sheet 5 on whose first side an image is printed, when the image printing parts are relatively large in the distribution, curling is likely to occur. Therefore, curling of the sheet 5 caused by printing the image on the first side of the sheet 5 can be suitably predicted and also the stopping time can be properly determined. Consequently, when the curling is not likely to occur, an unnecessary stopping process is not needed and lowering both sides printing speed caused by an unnecessary long stopping time can be prevented.

FIG. 13 is a flowchart showing both sides printing processes in the image forming apparatus according to a sixth embodiment of the present invention. Referring to FIG. 13, the both sides printing processes according to the sixth embodiment of the present invention are described. In the sixth embodiment of the present invention, an image printing rate on the total area and an image printing rate on the back end part of the sheet 5 on whose first side an image is printed are calculated and it is determined whether the sheet 5 is stopped being transported based on the calculated image printing rates.

The processes are described in detail. When both sides printing is executed (YES in S61), image data of an image which is printed on the first side of the sheet 5 are transferred to the printing controller 312 (S62) and the image is printed on the first side of the sheet 5 (S63). Then, an image printing rate on the total area and an image printing rate on the back end part of the sheet 5 on whose first side an image is printed are calculated based on the image data of the image which is printed on the first side of the sheet 5 (S64). Then, it is determined whether the sheet 5 on whose first side the image is printed must be stopped being transported based on the calculated image printing rates (S65). That is, stopping necessity is determined. When it is determined that the sheet 5 must be stopped after the image is printed on the first side of the sheet 5 (YES in S65), a stopping time is determined based on the calculated image printing rates (S66), and carrying the sheet 5 is stopped so that the sheet 5 is put on standby (S67). After the determined stopping time is passed (YES in S68), the sheet 5 is transported to the image forming region (image forming section 2) in which the recording head 24 is disposed and another image is printed on the second side of the sheet 5 (S69). Then, the sheet 5 is output (S70).

When it is determined that the sheet 5 does not have to be stopped being transported after the image is printed on the first side of the sheet 5 (NO in S65), another image is printed on the second side of the sheet 5 (S69), and the sheet 5 is output (S70).

As described above, in a case where at least one of the stopping necessity (standby necessity) and the stopping time of the sheet 5 is determined based on the image printing rates on the total area and on the back end part of the sheet 5 on whose first side an image is printed, when the image printing rate on the back end part (the tip part of the second side) of the sheet 5 is relatively larger than that on the total area of the sheet 5, curling is likely to occur. Therefore, curling of the sheet 5 caused by printing the image on the first side of the sheet 5 can be suitably predicted and also the stopping time can be properly determined. Consequently, when the curling is not likely to occur, an unnecessary stopping process is not needed and lowering both sides printing speed caused by an unnecessary long stopping time can be prevented.

FIG. 14 is a flowchart showing both sides printing processes in the image forming apparatus according to a seventh embodiment of the present invention. Referring to FIG. 14, the both sides printing processes according to the seventh embodiment of the present invention are described. In the seventh embodiment of the present invention, an image printing rate on the total area and a weighted image printing rate on the back end part of the sheet 5 on whose first side an image is printed are calculated and it is determined whether the sheet 5 is stopped being transported based on the calculated image printing rates.

The processes are described in detail. When both sides printing is executed (YES in S71), image data of an image which is printed on the first side of the sheet 5 are transferred to the printing controller 312 (S72) and the image is printed on the first side of the sheet 5 (S73). Then, an image printing rate on the total area and a weighted image printing rate on the back end part of the sheet 5 on whose first side an image is printed are calculated based on the image data of the image which is printed on the first side of the sheet 5 (S74). Then, it is determined whether the sheet 5 on whose first side the image is printed must be stopped being transported based on the calculated image printing rates (S75). That is, stopping necessity is determined. When it is determined that the sheet 5 must be stopped after the image is printed on the first side of the sheet 5 (YES in S75), a stopping time is determined based on the calculated image printing rates (S76), and carrying the sheet 5 is stopped so that the sheet 5 is put on standby (S77). After the determined stopping time is passed (YES in S78), the sheet 5 is transported to the image forming region (image forming section 2) in which the recording head 24 is disposed and another image is printed on the second side of the sheet 5 (S79). Then, the sheet 5 is output (S80).

When it is determined that the sheet 5 does not have to be stopped being transported after the image is printed on the first side of the sheet 5 (NO in S75), another image is printed on the second side of the sheet 5 (S79), and the sheet 5 is output (S80).

As described above, in a case where at least one of the stopping necessity (standby necessity) and the stopping time of the sheet 5 is determined based on the image printing rate on the total area and the weighted image printing rate on the back end part of the sheet 5 on whose first side an image is printed, when, for example, a solid image exists on the back end part of the sheet 5, curling is likely to greatly occur at the back end part. Therefore, the curling of the sheet 5 caused by printing the image on the first side of the sheet 5 can be more suitably predicted than that in the sixth embodiment and also the stopping time can be properly determined. Consequently, when the curling is not likely to occur, an unnecessary stopping process is not needed and lowering both sides printing speed caused by an unnecessary long stopping time can be prevented.

When the weighting factor in the weighted image printing rate on the back end part of the sheet 5 is set to be a variable, the stopping necessity and the stopping time can be set to be more precisely, and unnecessary stopping can be eliminated and productivity can be increased.

FIG. 15 is a flowchart showing both sides printing processes in the image forming apparatus according to an eighth embodiment of the present invention. Referring to FIG. 15, the both sides printing processes according to the eighth embodiment of the present invention are described. In the eight embodiment of the present invention, the number of ink droplets ejected on the first side of the sheet 5 is calculated and it is determined whether the sheet 5 is stopped being transported based on the calculated number of the ejected ink droplets.

The processes are described in detail. When both sides printing is executed (YES in S81), image data of an image which is printed on the first side of the sheet 5 are transferred to the printing controller 312 (S82) and the image is printed on the first side of the sheet 5 (S83). Then, the number of ink droplets ejected on the first side of the sheet 5 is calculated (S84). Then, it is determined whether the sheet 5 on whose first side the image is printed must be stopped being transported based on the calculated number of the ejected ink droplets (S85). That is, stopping necessity is determined. When it is determined that the sheet 5 must be stopped after the image is printed on the first side of the sheet 5 (YES in S85), a stopping time is determined based on the calculated number of the ejected ink droplets (S86), and carrying the sheet 5 is stopped so that the sheet 5 is put on standby (S87). After the determined stopping time is passed (YES in S88), the sheet 5 is transported to the image forming region (image forming section 2) in which the recording head 24 is disposed and another image is printed on the second side of the sheet 5 (S89). Then, the sheet 5 is output (S90).

When it is determined that the sheet 5 does not have to be stopped being transported after the image is printed on the first side of the sheet 5 (NO in S85), another image is printed on the second side of the sheet 5 (S89), and the sheet 5 is output (S90).

As described above, in a case where at least one of the stopping necessity (standby necessity) and the stopping time of the sheet 5 is determined based on the number of the ink droplets ejected on the first side of the sheet 5, when the number of ink droplets is relatively large, curling is likely to occur. Therefore, the curling of the sheet 5 caused by printing the image on the first side of the sheet 5 can be suitably predicted and also the stopping time can be properly determined. Consequently, when the curling is not likely to occur, an unnecessary stopping process is not needed and lowering both sides printing speed caused by an unnecessary long stopping time can be prevented.

FIG. 16 is a flowchart showing both sides printing processes in the image forming apparatus according to a ninth embodiment of the present invention. Referring to FIG. 16, the both sides printing processes according to the ninth embodiment of the present invention are described. In the ninth embodiment of the present invention, the number of ink droplets ejected on the total area and the number of ink droplets ejected on the back end part of the first side of the sheet 5 are calculated and it is determined whether the sheet 5 is stopped being transported based on the number of the ink droplets ejected on the total area and the number of the ink droplets ejected on the back end part of the first side of the sheet.

The processes are described in detail. When both sides printing is executed (YES in S91), image data of an image which is printed on the first side of the sheet 5 are transferred to the printing controller 312 (S92) and the image is printed on the first side of the sheet 5 (S93). Then, the number of ink droplets ejected on the total area and the number of ink droplets ejected on the back end part of the first side of the sheet 5 are calculated (S94). Then, it is determined whether the sheet 5 on whose first side the image is printed must be stopped being transported based on the calculated number of the ink droplets ejected on the total area and the calculated number of the ink droplets ejected on the back end part of the first side of the sheet 5 (S95). That is, stopping necessity is determined. When it is determined that the sheet 5 must be stopped after the image is printed on the first side of the sheet 5 (YES in S95), a stopping time is determined based on the calculated number of the ink droplets ejected on the total area and the calculated number of the ink droplets ejected on the back end part of the first side of the sheet 5 (S96), and carrying the sheet 5 is stopped so that the sheet 5 is put on standby (S97). After the determined stopping time is passed (YES in S98), the sheet 5 is transported to the image forming region (image forming section 2) in which the recording head 24 is disposed and another image is printed on the second side of the sheet 5 (S99). Then, the sheet 5 is output (S100).

When it is determined that the sheet 5 does not have to be stopped being transported after the image is printed on the first side of the sheet (NO in S95), another image is printed on the second side of the sheet 5 (S99), and the sheet 5 is output (S100).

As described above, in a case where at least one of the stopping necessity (standby necessity) and the stopping time of the sheet 5 is determined based on the calculated number of the ink droplets ejected on the total area and the calculated number of the ink droplets ejected on the back end part of the first side of the sheet 5, when the calculated number of the ink droplets ejected on the back end part is relatively larger than that on the total area of the first side of the sheet 5, curling is likely to occur. Therefore, the curling of the sheet 5 caused by printing the image on the first side of the sheet 5 can be suitably predicted and also the stopping time can be properly determined. Consequently, when the curling is not likely to occur, an unnecessary stopping process is not needed and lowering both sides printing speed caused by an unnecessary long stopping time can be prevented.

FIG. 17 is a flowchart showing both sides printing processes in the image forming apparatus according to a tenth embodiment of the present invention. Referring to FIG. 17, the both sides printing processes according to the tenth embodiment of the present invention are described. In the tenth embodiment of the present invention, the number of ink droplets ejected on the total area and the weighted number of ink droplets ejected on the back end part of the first side of the sheet 5 are calculated and it is determined whether the sheet 5 is stopped being transported based on the calculated number of the ink droplets ejected on the total area and the calculated weighted number of the ink droplets ejected on the back end part of the first side of the sheet.

The processes are described in detail. When both sides printing is executed (YES in S101), image data of an image which is printed on the first side of the sheet 5 are transferred to the printing controller 312 (S102) and the image is printed on the first side of the sheet 5 (S103). Then, the number of ink droplets ejected on the total area and the weighted number of ink droplets ejected on the back end part of the first side of the sheet 5 are calculated (S104). Then, it is determined whether the sheet 5 on whose first side the image is printed must be stopped being transported based on the calculated number of the ink droplets ejected on the total area and the calculated weighted number of the ink droplets ejected on the back end part of the first side of the sheet 5 (S105). That is, stopping necessity is determined. When it is determined that the sheet 5 must be stopped after the image is printed on the first side of the sheet 5 (YES in S105), a stopping time is determined based on the calculated number of the ink droplets ejected on the total area and the calculated weighted number of the ink droplets ejected on the back end part of the first side of the sheet 5 (S106), and carrying the sheet 5 is stopped so that the sheet 5 is put on standby (S107). After the determined stopping time is passed (YES in S108), the sheet 5 is transported to the image forming region (image forming section 2) in which the recording head 24 is disposed and another image is printed on the second side of the sheet 5 (S109). Then, the sheet 5 is output (S110).

When it is determined that the sheet 5 does not have to be stopped being transported after the image is printed on the first side of the sheet 5 (NO in S105), another image is printed on the second side of the sheet 5 (S109), and the sheet 5 is output (S110).

As described above, in a case where at least one of the stopping necessity (standby necessity) and the stopping time of the sheet 5 is determined based on the calculated number of the ink droplets ejected on the total area and the calculated weighted number of the ink droplets ejected on the back end part of the first side of the sheet 5, when, for example, a solid image is on the back end part of the sheet 5, curling is likely to greatly occur at the back end part. Therefore, the curling of the sheet 5 caused by printing the image on the first side of the sheet 5 can be more suitably predicted than that in the ninth embodiment and also the stopping time can be properly determined. Consequently, when the curling is not likely to occur, an unnecessary stopping process is not needed and lowering both sides printing speed caused by an unnecessary long stopping time can be prevented.

When the weighting factor in the weighted number of the ink droplets ejected on the back end part of the first side of the sheet 5 is set to be a variable, the stopping necessity and the stopping time can be set more precisely, and unnecessary stopping can be eliminated and productivity can be increased.

In addition, in the image forming apparatus according to the present embodiment, in order to calculate the amount of consumed ink, the number of ink droplets ejected from the recording head 24 is counted. Therefore, the number of ink droplets ejected on the total area and the back end part can be easily obtained.

Figure 18:
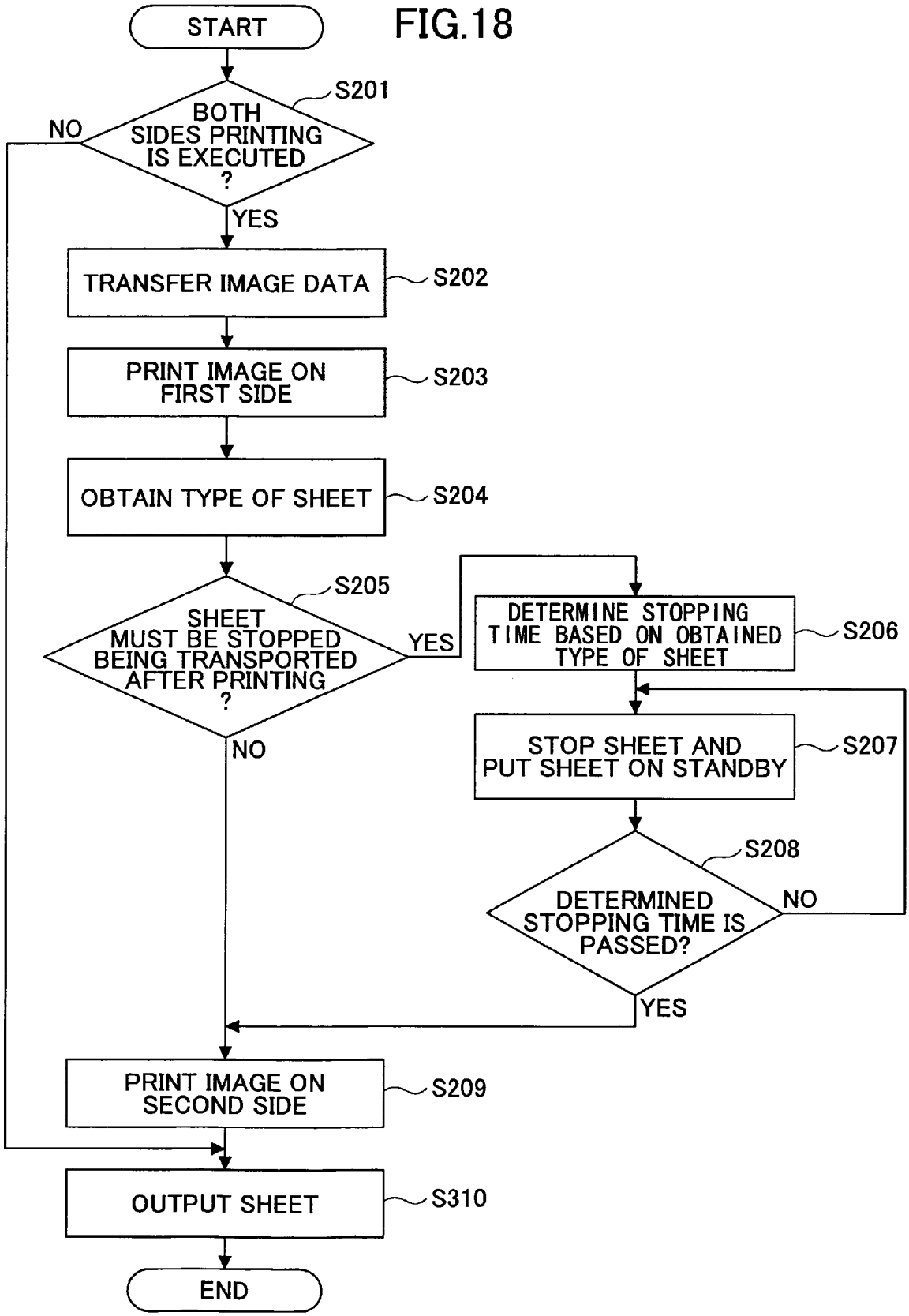
FIG. 18 is a flowchart showing both sides printing processes in the image forming apparatus according to an eleventh embodiment of the present invention.

FIG. 18 is a flowchart showing both sides printing processes in the image forming apparatus according to an eleventh embodiment of the present invention. Referring to FIG. 18, the both sides printing processes according to the eleventh embodiment of the present invention are described. In the eleventh embodiment of the present invention, it is determined whether the sheet 5 is stopped being transported based on the type of the sheet 5.

The processes are described in detail. When both sides printing is executed (YES in S201), image data of an image which is printed on the first side of the sheet 5 are transferred to the printing controller 312 (S202) and the image is printed on the first side of the sheet 5 (S203). Then, the type of the sheet 5 is obtained (S204). Then, it is determined whether the sheet 5 on whose first side the image is printed must be stopped being transported based on the type of the sheet 5 (S205). That is, stopping necessity is determined. When it is determined that the sheet 5 must be stopped after the image is printed on the first side of the sheet 5 (YES in S205), a stopping time is determined based on the type of the sheet 5 (S206), and carrying the sheet 5 is stopped so that the sheet 5 is put on standby (S207). After the determined stopping time is passed (YES in S208), the sheet 5 is transported to the image forming region (image forming section 2) in which the recording head 24 is disposed and another image is printed on the second side of the sheet 5 (S209). Then, the sheet 5 is output (S210).

When it is determined that the sheet 5 does not have to be stopped being transported after the image is printed on the first side of the sheet 5 (NO in S205), another image is printed on the second side of the sheet 5 (S209), and the sheet 5 is output (S210).

As described above, in a case where at least one of the stopping necessity (standby necessity) and the stopping time of the sheet 5 is determined based on the type of the sheet 5, since curling is likely to occur in a type of sheet and not occur in another type of sheet depending on the type of the sheet 5, the curling of the sheet 5 caused by printing the image on the first side of the sheet 5 can be suitably predicted and also the stopping time can be properly determined. Consequently, when the curling is not likely to occur, an unnecessary stopping process is not needed and lowering both sides printing speed caused by an unnecessary long stopping time can be prevented.

Information of the type of the sheet 5 can be input from the operating board and display 327 or the information can be designated by a printer driver of an external personal computer (not shown).

Figure 19:
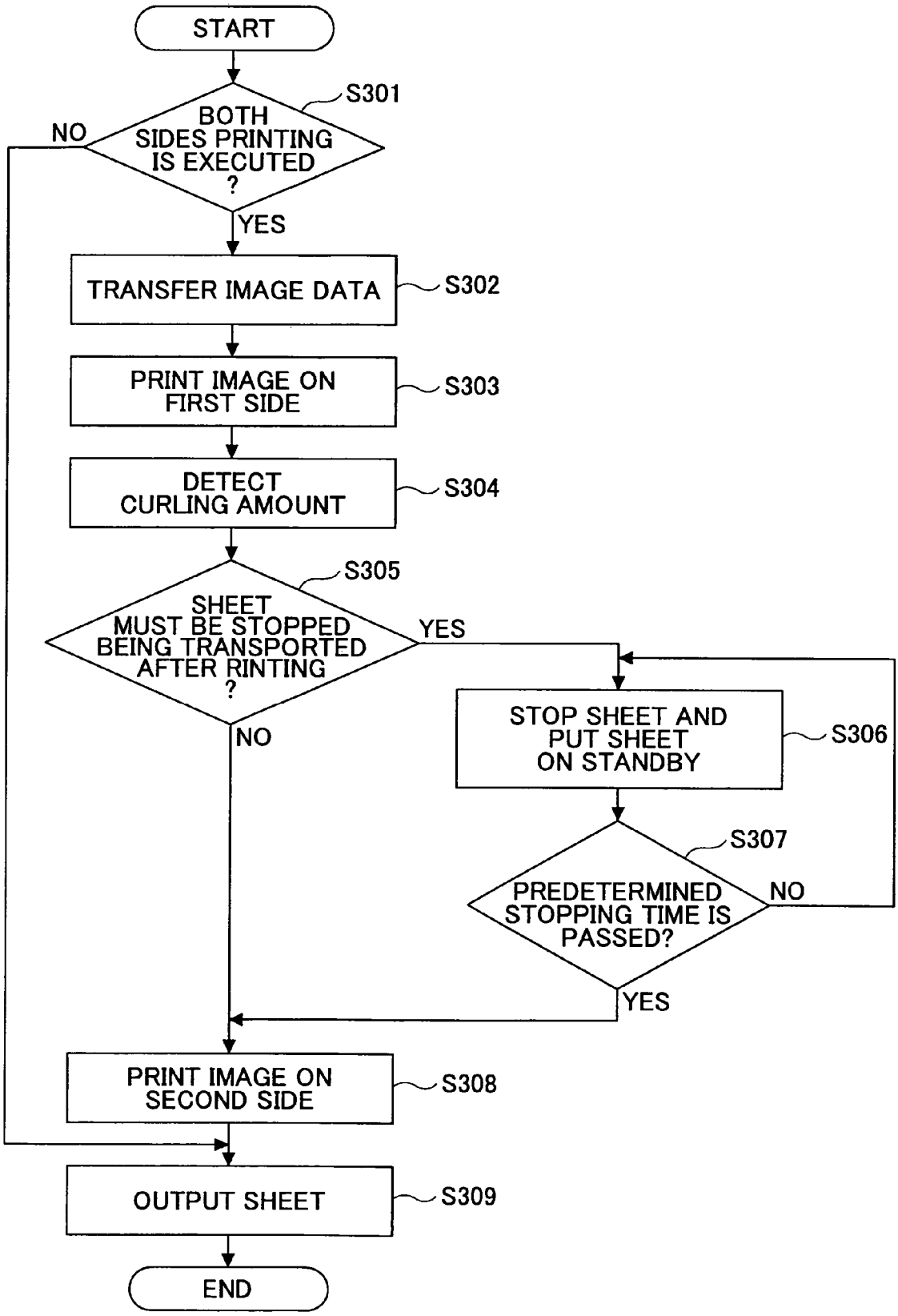
FIG. 19 is a flowchart showing both sides printing processes in the image forming apparatus according to a twelfth embodiment of the present invention.

FIG. 19 is a flowchart showing both sides printing processes in the image forming apparatus according to a twelfth embodiment of the present invention. Referring to FIG. 19, the both sides printing processes according to the twelfth embodiment of the present invention are described. In the twelfth embodiment of the present invention, it is determined whether the sheet 5 is stopped being transported based on the curling amount which is detected after printing an image on the first side of the sheet 5.

The processes are described in detail. When both sides printing is executed (YES in S301), image data of an image which is printed on the first side of the sheet 5 are transferred to the printing controller 312 (S302) and the image is printed on the first side of the sheet 5 (S303). Then, the curling amount of the sheet 5 is detected after printing the image on the first side of the sheet 5 (S304). Then, it is determined whether the sheet 5 on whose first side the image is printed must be stopped being transported based on the detected curling amount (S305). That is, stopping necessity is determined. When it is determined that the sheet 5 must be stopped after the image is printed on the first side of the sheet 5 (YES in S305), carrying the sheet 5 is stopped for a predetermined stopping time and the sheet 5 is put on standby (S306). After the predetermined stopping time is passed (YES in S307), the sheet 5 is transported to the image forming region (image forming section 2) in which the recording head 24 is disposed and another image is printed on the second side of the sheet 5 (S308). Then, the sheet 5 is output (S309).

When it is determined that the sheet 5 does not have to be stopped being transported after the image is printed on the first side of the sheet (NO in S305), another image is printed on the second side of the sheet 5 (S308), and the sheet 5 is output (S309).

As described above, the stopping necessity (standby necessity) of the sheet 5 is determined based on the detected amount of curling of the sheet 5 after printing an image on the first side of the sheet 5 and the sheet 5 is stopped being transported for a predetermined time when the curling amount is over a predetermined amount. Consequently, when the curling does not occur, an unnecessary stopping process is not needed and lowering both sides printing speed caused by an unnecessary long stopping time can be prevented.

Figure 20:
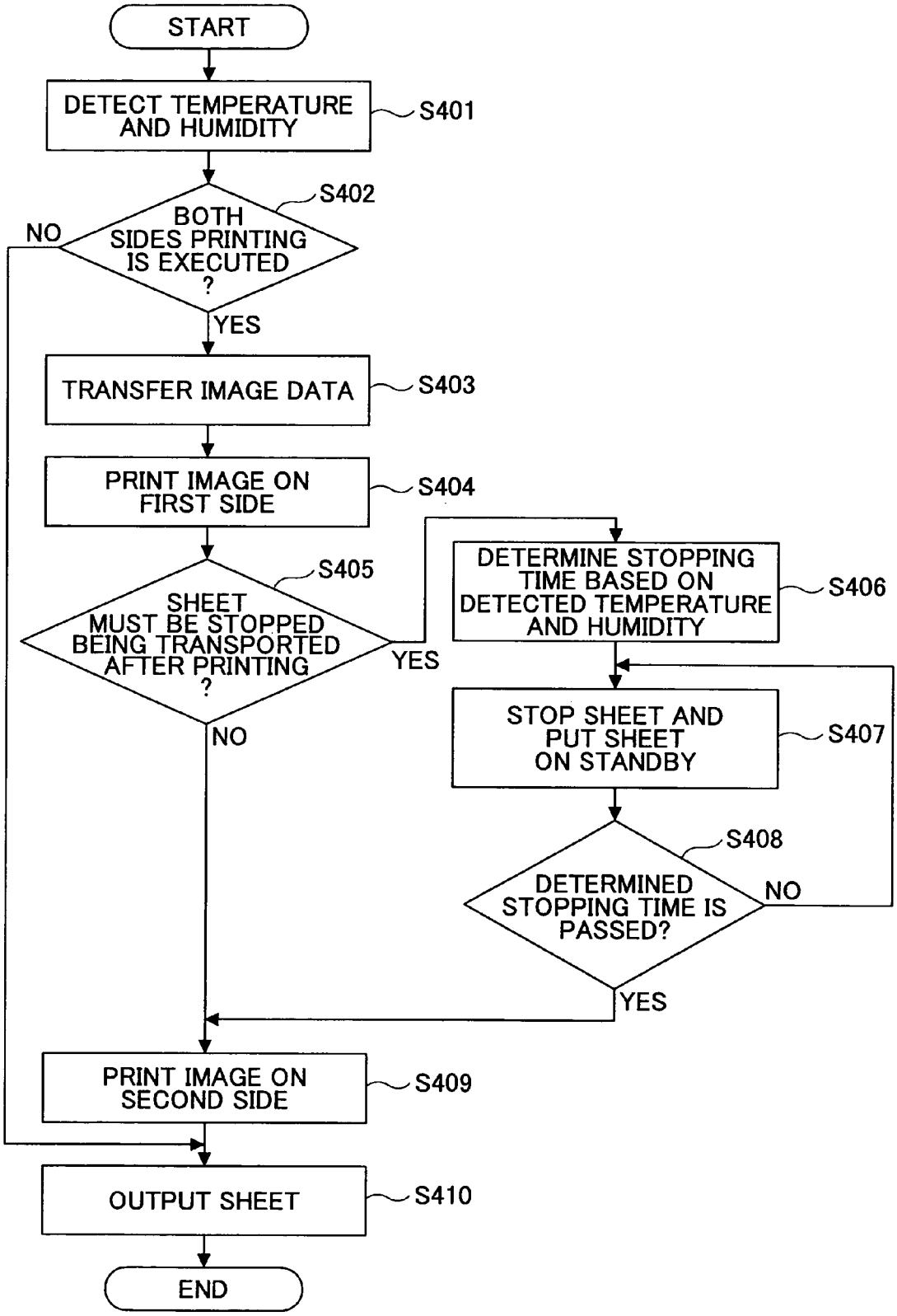
FIG. 20 is a flowchart showing both sides printing processes in the image forming apparatus according to a thirteenth embodiment of the present invention.

FIG. 20 is a flowchart showing both sides printing processes in the image forming apparatus according to a thirteenth embodiment of the present invention. Referring to FIG. 20, the both sides printing processes according to the thirteenth embodiment of the present invention are described. In the thirteenth embodiment of the present invention, it is determined whether the sheet 5 is stopped being transported based on a signal detected by the temperature and humidity sensor 234.

The processes are described in detail. First, temperature and/or humidity at a position in the image forming apparatus are detected (S401). When both sides printing is executed (YES in S402), image data of an image which is printed on the first side of the sheet 5 are transferred to the printing controller 312 (S403) and the image is printed on the first side of the sheet 5 (S404). Then, it is determined whether the sheet 5 on whose first side the image is printed must be stopped being transported based on the detected temperature and/or humidity (S405). That is, stopping necessity is determined. When it is determined that the sheet 5 must be stopped after the image is printed on the first side of the sheet 5 (YES in S405), a stopping time is determined based on the detected temperature and/or humidity (S406). Then, carrying the sheet 5 is stopped for the determined stopping time and the sheet 5 is put on standby (S407). After the determined stopping time is passed (YES in S408), the sheet 5 is transported to the image forming region (image forming section 2) in which the recording head 24 is disposed and another image is printed on the second side of the sheet 5 (S409). Then, the sheet 5 is output (S410).

When it is determined that the sheet 5 does not have to be stopped being transported after the image is printed on the first side of the sheet 5 (NO in S405), another image is printed on the second side of the sheet 5 (S409), and the sheet 5 is output (S410).

As described above, in a case where at least one of the stopping necessity (standby necessity) and the stopping time of the sheet 5 is determined based on the detected temperature and/or humidity, when the curling is not likely to occur, an unnecessary stopping process is not needed and lowering both sides printing speed caused by an unnecessary long stopping time can be prevented.

That is, occurrence of curling of the sheet 5 by printing an image on the first side of the sheet 5 is affected by temperature and/or humidity at a position in the image forming apparatus. Curling is likely to occur under low temperature and low humidity conditions and is likely not to occur under high humidity. Therefore, when the stopping necessity and the stopping time are determined based on the detected temperature and humidity, the both sides printing is executed without stopping the sheet 5 under the condition in which the curling is not likely to occur. With this, productivity in the both sides printing can be increased.

The position of the temperature and humidity sensor 234 can be one of many positions. When the temperature and humidity sensor 234 is disposed at the position 234A in the sheet feeding section 4 shown in FIG. 1, the temperature and/or humidity of the sheet 5 can be accurately detected. When the temperature and humidity sensor 234 is disposed at the position 234B in the guiding member 35 which guides the transport belt 31 shown in FIG. 3, the temperature and/or humidity near the position where the sheet 5 contacts the transport belt 31 can be detected. Further, when the temperature and humidity sensor 234 is disposed at the position 234C in the carriage 23 shown in FIG. 3, the temperature and/or humidity near the position where the sheet 5 contacts the transport belt 31 can be detected. With this, the stopping necessity and the stopping time can be more suitably determined. In this, the temperature and humidity sensor 234 can be disposed at plural positions described above.

FIG. 21 is a flowchart showing both sides printing processes in the image forming apparatus according to a fourteenth embodiment of the present invention. Referring to FIG. 21, the both sides printing processes according to the fourteenth embodiment of the present invention are described. In the fourteenth embodiment of the present invention, the stopping time is fixed by combining the eighth embodiment and the thirteenth embodiment.

The processes are described in detail. First, temperature and/or humidity at a position in the image forming apparatus are detected by the temperature and humidity sensor 234 (S501). When both sides printing is executed (YES in S502), image data of an image which is printed on the first side of the sheet 5 are transferred to the printing controller 312 (S503) and the image is printed on the first side of the sheet 5 (S504). Then, the number of ink droplets ejected on the first side of the sheet 5 is calculated (S505). Then, it is determined whether the sheet 5 on whose first side the image is printed must be stopped being transported based on the detected temperature and/or humidity and the calculated number of the ink droplets (S506). That is, stopping necessity is determined. When it is determined that the sheet 5 must be stopped after the image is printed on the first side of the sheet 5 (YES in S506), carrying the sheet 5 is stopped for a fixed stopping time and the sheet 5 is put on standby (S507). After the fixed stopping time is passed (YES in S508), the sheet 5 is transported to the image forming region (image forming section 2) in which the recording head 24 is disposed and another image is printed on the second side of the sheet 5 (S509). Then, the sheet 5 is output (S510).

When it is determined that the sheet 5 does not have to be stopped being transported after the image is printed on the first side of the sheet 5 (NO in S506), another image is printed on the second side of the sheet 5 (S509), and the sheet 5 is output (S510).

As described above, the stopping necessity (standby necessity) and the stopping time of the sheet 5 can be determined by combining the above described embodiments. In addition to the above combination, at least two or more of the above embodiments can be combined, that is, the image data, the printing area, the image density, the number of ink droplets, the type of sheet, and so on can be combined. With this, curling can be decreased and lowering the productivity can be prevented.

Next, the stopping position of the sheet 5 is described. The stopping time of the sheet 5 is, for example, the time when the end of the sheet 5 is passed through the image forming region (image forming section 2) after an image is printed on the first side of the sheet 5 or the time when the end of the sheet 5 is passed through the printing section exit sensor 204 after the image is printed on the first side of the sheet 5.

Figure 22:
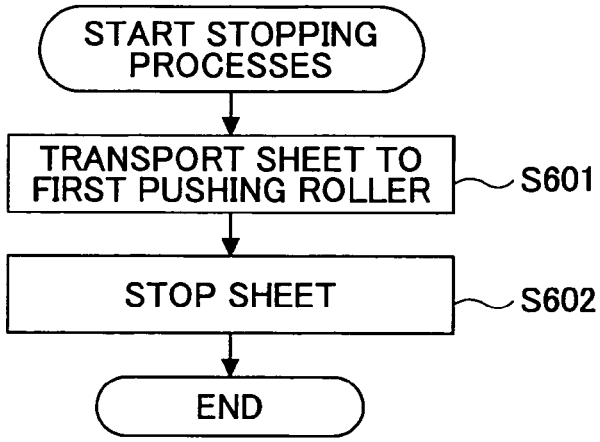
FIG. 22 is a flowchart showing stopping processes of the sheet according to the embodiments of the present invention.
Figure 23:
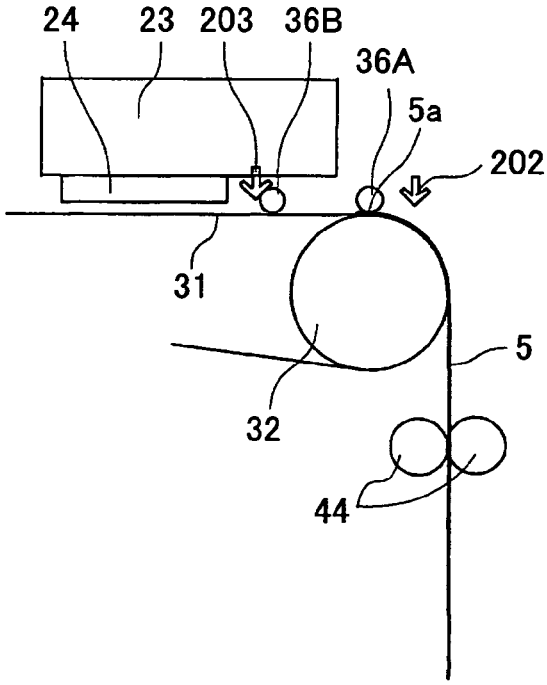
FIG. 23 is a schematic diagram showing a stopping position of the sheet when the stopping processes shown in FIG. 22 are executed.

FIG. 22 is a flowchart showing stopping processes of the sheet 5 according to the embodiments of the present invention. FIG. 23 is a schematic diagram showing a stopping position of the sheet 5 when the stopping processes shown in FIG. 22 are executed. As shown in FIGS. 22 and 23, the sheet 5 is transported to the position of the first pushing roller 36A (S601) and the sheet 5 is stopped at the position (S602). In more detail, the sheet 5 can be stopped when the tip 5*a* of the second side of the sheet 5 is sandwiched between the first pushing roller 36A and the transport belt 31 by being transported to the position. As described above, by putting the sheet 5 on standby by sandwiching the tip 5*a* of the second side of the sheet 5 between the first pushing roller 36A and the transport belt 31, curling of the sheet 5 can be surely decreased.

Figure 24:
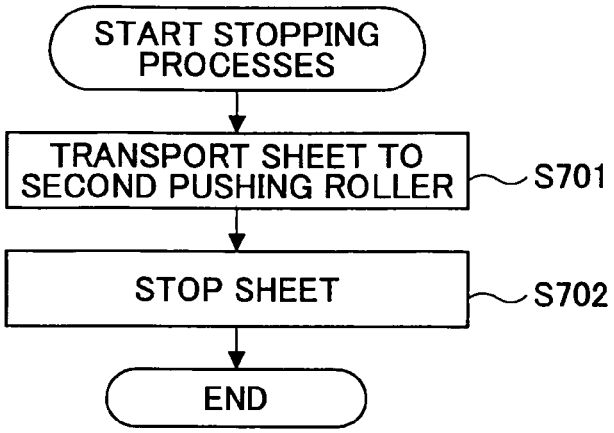
FIG. 24 is another flowchart showing stopping processes of the sheet according to the embodiments of the present invention.
Figure 25:
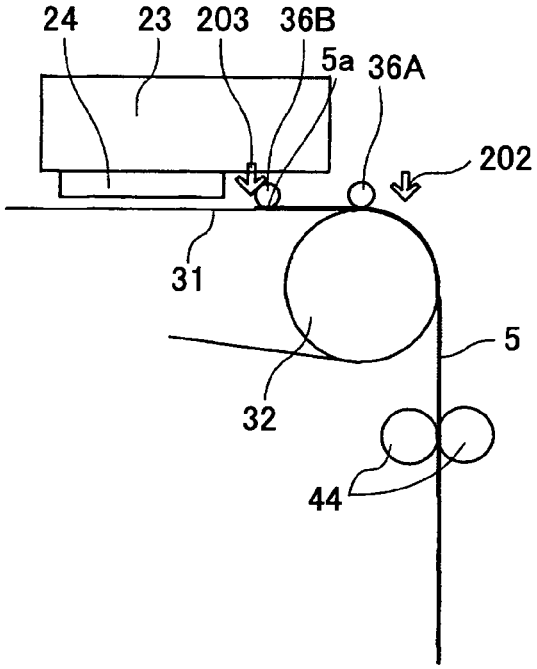
FIG. 25 is another schematic diagram showing a stopping position of the sheet when the stopping processes shown in FIG. 24 are executed.

FIG. 24 is another flowchart showing stopping processes of the sheet 5 according to the embodiments of the present invention. FIG. 25 is another schematic diagram showing a stopping position of the sheet 5 when the stopping processes shown in FIG. 24 are executed. As shown in FIGS. 24 and 25, the sheet 5 is transported to the position of the second pushing roller 36B (tip pushing roller) (S701) and the sheet 5 is stopped at the position (S702). In more detail, the sheet 5 is stopped when the tip 5*a* of the second side of the sheet 5 is sandwiched between the second pushing roller 36B and the transport belt 31 by being transported to the position. As described above, by putting the sheet 5 on standby by sandwiching the tip 5*a* of the second side of the sheet 5 between the second pushing roller 36B and the transport belt 31, curling of the sheet 5 can be surely decreased.

In the above description, the embodiments of the present invention are applied to a multifunctional image forming apparatus. However, the embodiments of the present invention can be applied to image forming apparatuses such as a printer, a facsimile, and so on. In addition, the embodiments of the present invention can be applied to an image forming apparatus which uses recording liquid other than ink.

Further, the present invention is not limited to the specifically disclosed embodiments, and variations and modifications may be made without departing from the scope of the present invention.

The present invention is based on Japanese Priority Patent Application No. 2005-269437, filed on Sep. 16, 2005, with the Japanese Patent Office, the entire contents of which are hereby incorporated by reference.

What is claimed is:

1. An image forming apparatus, comprising:

a transport belt rotating around rollers that transports a sheet by attaching the sheet thereto by an electrostatic force;

an image forming unit which forms an image on the sheet transported by the transport belt by ejecting ink droplets from a recording head onto the sheet;

an duplex print unit which reverses the sheet, the first side of which has been printed, so as to form an image on the second side of the sheet;

a carrying roller configured to transport the transport belt; and a first pushing roller disposed to face the carrying roller and configured to push the sheet to the transport belt, wherein the sheet is stopped so that a tip of the sheet is sandwiched between the first pushing roller and the transport belt, and wherein the apparatus stops the transportation of the sheet to the image forming unit after, the image is formed on the first side of the sheet and before the image is formed on the second side of the sheet until at least the tip of the second side of the sheet is not apart from the transport belt wherein the apparatus is configured to determine whether to stop the transportation of the sheet, the first side of which has been printed, to the image forming unit based on the information of the image to be printed on the first side of the sheet.

2. The image forming apparatus as claimed in claim 1, wherein:

the apparatus changes the duration of stopping the transportation of the sheet, the first side of which has been printed, to the image forming unit based on the information of the image to be printed on the first side of the sheet.

3. The image forming apparatus as claimed in claim 1, wherein: the information includes an printing area of the image on the total area of the first side of the sheet.

4. The image forming apparatus as claimed in claim 1, wherein: the information includes an image density of the image on the total area of the first side of the sheet.

5. The image forming apparatus as claimed in claim 1, wherein:

the information of the image includes proportions among different size of the ink droplets to be used for printing the image on the first side of the sheet.

6. The image forming apparatus as claimed in claim 1, wherein:

the information of the image includes distribution of printing parts of the image on the total area of the first side of the sheet.

7. The image forming apparatus as claimed in claim 2, wherein:

the information of the image is an image printing rate on the total area and an image printing rate on the back end part of the image on the first side of the sheet.

8. The image forming apparatus as claimed in claim 2, wherein:

the information of the image is an image printing rate on the total area and a weighted image printing rate on the back end part of the image on the first side of the sheet.

9. The image forming apparatus as claimed in claim 8, wherein:

a weighting factor for the weighted image printing rate is a variable.

10. The image forming apparatus as claimed in claim 1, wherein:

at least one of the stopping necessity of the sheet and the stopping time of the sheet is determined based on the number of ink droplets ejected on the first side of the sheet.

11. The image forming apparatus as claimed in claim 10, wherein:

the number of ink droplets ejected on the first side of the sheet is the number of ink droplets ejected on the total area and the number of ink droplets ejected on the back end part of the first side of the sheet.

12. The image forming apparatus as claimed in claim 10, wherein: the number of ink droplets ejected on the first side of the sheet is the number of ink droplets ejected on the total area and the weighted number of ink droplets ejected on the back end part of the first side of the sheet.

13. The image forming apparatus as claimed in claim 12, wherein:

a weighting factor for the weighted number of ink droplets is a variable.

14. The image forming apparatus as claimed in claim 1, wherein:

at least one of the stopping necessity of the sheet and the stopping time of the sheet is determined based on the type of the sheet.

15. The image forming apparatus as claimed in claim 1, wherein:

at least one of the stopping necessity of the sheet and the stopping time of the sheet is determined based on temperature and/or humidity.

16. The image forming apparatus as claimed in claim 15, wherein: at least one temperature and humidity detecting unit is disposed in a sheet feeding section which feeds the sheet, a belt guiding member which guides the transport belt, or a carriage which transports the recording head disposed in the image forming unit.

17. The image forming apparatus as claimed in claim 1, wherein:

at least one of the stopping necessity of the sheet and the stopping time of the sheet is determined based on a combination of at least two of information of the image which is printed on the first side of the sheet, the number of ink droplets ejected on the first side of the sheet, the type of the sheet, and temperature and/or humidity.

18. The image forming apparatus as claimed in claim 1, further comprising:

a second pushing roller which is disposed right before the image forming unit and pushes the sheet to the transport belt; wherein the sheet is stopped so that the tip of the sheet is sandwiched between the second pushing roller and the transport belt.

19. The image forming apparatus as claimed in claim 2, wherein: the information includes an printing area of the image on the total area of the first side of the sheet.

20. The image forming apparatus as claimed in claim 2, wherein: the information includes an image density of the image on the total area of the first side of the sheet.

21. The image forming apparatus as claimed in claim 2, wherein: the information of the image includes proportions among different size of the ink droplets to be used for printing the image on the first side of the sheet.

22. The image forming apparatus as claimed in claim 2, wherein: the information of the image includes distribution of printing parts of the image on the total area of the first side of the sheet.

* * * * *